US011552425B2

(12) United States Patent
Tiemann et al.

(10) Patent No.: US 11,552,425 B2
(45) Date of Patent: Jan. 10, 2023

(54) HOLDING FRAME FOR A PLUG CONNECTOR AND METHODS OF POPULATING SAME

(71) Applicant: HARTING Electric GmbH & Co. KG, Espelkamp (DE)

(72) Inventors: Andre Tiemann, Bad Essen (DE); Heiko Meier, Minden (DE); Andre Beneke, Vechta (DE); Jörg Ziegenhahn, Büren (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 93 days.

(21) Appl. No.: 17/318,584

(22) Filed: May 12, 2021

(65) Prior Publication Data

US 2021/0265767 A1 Aug. 26, 2021

Related U.S. Application Data

(63) Continuation of application No. 16/606,654, filed as application No. PCT/DE2018/100330 on Apr. 11, 2018, now Pat. No. 11,038,304.

(30) Foreign Application Priority Data

Apr. 20, 2017 (DE) ..... 10 2017 108 432.0

(51) Int. Cl.
*H01R 13/514* (2006.01)
*H01R 13/518* (2006.01)
*H01R 43/20* (2006.01)

(52) U.S. Cl.
CPC ..... *H01R 13/518* (2013.01); *H01R 43/20* (2013.01)

(58) Field of Classification Search
CPC ..... H01R 13/518; H01R 43/20
See application file for complete search history.

(56) References Cited

U.S. PATENT DOCUMENTS

| | | | |
|---|---|---|---|
| 3,559,813 | A | 2/1971 | Sosinski |
| 3,576,520 | A | 4/1971 | Stauffer |
| 4,032,209 | A | 6/1977 | Rutkowski |
| 5,595,507 | A | 1/1997 | Braun et al. |
| 5,795,174 | A | 8/1998 | Saito et al. |
| 6,004,162 | A | 12/1999 | Harting et al. |
| 7,303,446 | B2 | 12/2007 | Hills et al. |
| 7,316,591 | B2 | 1/2008 | Ferderer |
| 7,591,677 | B2 | 9/2009 | Bade et al. |
| 8,512,067 | B2 | 8/2013 | Denter et al. |
| 9,257,788 | B1 | 2/2016 | Jia |

(Continued)

FOREIGN PATENT DOCUMENTS

| | | | |
|---|---|---|---|
| CN | 1989658 | A | 6/2007 |
| CN | 203277786 | U | 11/2013 |

(Continued)

OTHER PUBLICATIONS

International Search Report and Written Opinion, dated Jul. 11, 2018, for International Application No. PCT/DE2018/100331, 13 pages (with English translation of Search Report).

*Primary Examiner* — Neil Abrams
(74) *Attorney, Agent, or Firm* — Seed IP Law Group LLP

(57) ABSTRACT

Holding frames for modules are provided and in particular holding frames for a plug connector for receiving similar and/or different modules and fixedly securing the modules within the holding frames.

9 Claims, 15 Drawing Sheets

(56) References Cited

U.S. PATENT DOCUMENTS

| | | | | |
|---|---|---|---|---|
| 9,356,390 | B2 | 5/2016 | Annis et al. | |
| 9,502,813 | B2 | 11/2016 | Dugo | |
| 9,720,195 | B2 | 8/2017 | Giraud et al. | |
| 10,177,484 | B2 | 1/2019 | Schönfeld et al. | |
| 10,276,965 | B2 | 4/2019 | Herbrechtsmeier et al. | |
| 10,283,900 | B2 | 5/2019 | Herbrechtsmeier et al. | |
| 10,333,244 | B2 | 6/2019 | Herbrechtsmeier et al. | |
| 10,340,624 | B2 | 7/2019 | Schönfeld et al. | |
| 10,396,488 | B2 | 8/2019 | Wölffle | |
| 10,418,773 | B2 | 9/2019 | Herbrechtsmeier | |
| 10,530,090 | B2 | 1/2020 | Wolff et al. | |
| 10,559,911 | B2 | 2/2020 | Herbrechtsmeier | |
| 10,665,981 | B2 | 5/2020 | Mossig et al. | |
| 10,665,982 | B2 | 5/2020 | Herbrechtsmeier et al. | |
| 10,686,278 | B2 | 6/2020 | Herbrechtsmeier et al. | |
| 10,756,475 | B2 | 8/2020 | Tiemann et al. | |
| 10,892,572 | B2 * | 1/2021 | Diessel | H01R 31/085 |
| 11,038,304 | B2 * | 6/2021 | Tiemann | H01R 43/20 |
| 11,289,847 | B2 * | 3/2022 | Best | H01R 13/514 |
| 2006/0019548 | A1 | 1/2006 | Baker et al. | |
| 2007/0155252 | A1 | 7/2007 | Ferderer | |
| 2020/0251849 | A1 | 8/2020 | Tiemann et al. | |
| 2022/0029346 | A1 * | 1/2022 | Tiemann | H01R 13/745 |

FOREIGN PATENT DOCUMENTS

| | | | |
|---|---|---|---|
| CN | 203326246 | U | 12/2013 |
| CN | 205609835 | U | 9/2016 |
| CN | 205680860 | U | 11/2016 |
| CN | 206098894 | U | 4/2017 |
| DE | 298 12 500 | U1 | 9/1998 |
| DE | 20 2010 009 199 | U1 | 9/2010 |
| DE | 10 2013 113 976 | A1 | 6/2015 |
| DE | 20 2015 106 434 | U1 | 4/2017 |
| EP | 0 860 906 | A2 | 8/1998 |
| EP | 1 801 927 | A1 | 6/2007 |
| EP | 2 312 700 | A1 | 4/2011 |
| EP | 2 581 991 | A2 | 4/2013 |
| EP | 2 945 229 | A1 | 11/2015 |
| JP | 8-273753 | A | 10/1996 |
| JP | 2010-80083 | A | 4/2010 |
| WO | 2014/155171 | A1 | 10/2014 |
| WO | 2016/150565 | A1 | 9/2016 |
| WO | 2017/036928 | A1 | 3/2017 |

* cited by examiner

HOLDING FRAME FOR A PLUG CONNECTOR AND METHODS OF POPULATING SAME

CROSS-REFERENCE TO RELATED APPLICATIONS

This application is a continuation of U.S. patent application Ser. No. 16/606,654, filed Mar. 18, 2020, which is a 371 of PCT/DE2018/100330 filed Apr. 11, 2018, which claims priority to German Patent Application No. 10 2017 108 432.0, filed Apr. 20, 2017, the entire contents of which are hereby incorporated by reference herein.

BACKGROUND

Technical Field

The present disclosure relates to the field of holding frames for modules and in particular of holding frames for a plug connector for receiving similar and/or different modules.

Holding frames are used to accommodate a plurality of similar and/or different modules. These modules may be insulating bodies, for example, which are provided as contact holders for electronic and electrical and possibly also for optical and/or pneumatic contacts.

Description of the Related Art

A holding frame for holding plug connector modules and for installing in plug connection casings or for screwing onto wall surfaces is known from document EP 0 860 906 B1, wherein the plug connector modules are inserted into the holding frame and holding means on the plug connector modules cooperate with recesses provided on opposite wall parts (side parts) of the holding frame, wherein the recesses in the form of openings which are bounded on all sides are provided in the side parts of the holding frame, wherein the holding frame consists of two halves articulatedly connected to each other, wherein the holding frame separates along a line which is parallel to the side parts of the holding frame, and wherein hinges are arranged in fastening ends of the holding frame in such a way that when the holding frame is screwed onto a fastening surface, the frame parts are oriented in such a way that the side parts of the holding frame are oriented at right angles to the fastening surface and the plug connector modules are connected interlockingly to the holding frame by the holding means. In practice, such holding frames are normally made in a die casting process, and more particularly in a zinc die casting process.

Document EP 2 581 991 A1 discloses a holding frame for plug connector modules, comprising two frame halves which can be latched to each other by linear displacement of the one frame half relative to the other frame half in a sliding direction, wherein mutually corresponding latching means are provided on the frame halves and cause the two frame halves to latch into each other in two different latching positions during linear displacement, in which the frame halves are spaced from each other at different distances.

Practice has shown, however, that assembling such holding frames is a time-consuming operation. For example, such holding frames have to be screwed and/or latched out of the plug connector as soon as just one single module needs replacing. It is possible that the other modules, whose removal is not at all desired, could fall out of the holding frame and have to be inserted again before the frame halves are screwed together again and/or before the frame halves latch together. Before the frame halves can be joined, all the modules must simultaneously be in the position provided for them, so that they can finally be fixed in place in the holding frame when the frame halves are joined together. This makes assembly more difficult.

Document EP 1 801 927 B1 discloses a holding frame consisting of an integral injection-molded plastic part. The holding frame is formed as a circumferential collar and on its mating side has a plurality of wall segments which are separated by slits. A respective pair of opposite wall segments form an insertion region for a plug-in module, the wall segments having window-like apertures for receiving projections integrally-molded with the narrow sides of the modules. A guide groove is also provided in each of the wall segments. The guide groove is formed above the apertures by means of an outwardly offset window web which has an insertion bevel on the inner surface. The plug-in modules also have latching arms integrally-molded on the narrow sides, which act in the direction of the cable connectors, and which latch into place under the lateral collar wall, so that two independent latching means fix the plug connector module in the holding frame.

One disadvantage of this prior art is that it is a holding frame made of plastic, which is generically unsuitable for protective earthing according to the EN 61984 standard for connectors, which therefore means that such a holding frame cannot be used for installation in metal plug connector casings. The use of metal plug connector casings requires such protective earthing, however, and in many cases is necessary and therefore desired by customers because of the mechanical robustness, temperature resistance and electrical shielding properties of such casings. It has also been found that manufacturing the aforementioned plastic holding frames by injection-molding is difficult at the least and can only be achieved with great effort and expenditure. Finally, the heat resistance of such a plastic holding frame is not always sufficient for special applications, either, for example, near a blast furnace.

In order to specify a structural design for a holding frame which has good heat resistance and high mechanical robustness and which allows protective earthing, also and in particular when installed in a metal plug connector casing, and which also ensures ease of operation, especially when replacing individual modules, document DE 10 2013 113 976 A1 proposes providing a base section (preferably die cast and made of zinc or aluminum or an appropriate alloy, for example) for fixing a received module in a plane, and a deformation section (preferably a die formed resilient metal sheet) which can adopt an insertion state and a holding state, the insertion state allowing at least one module to be inserted into the holding frame in a direction transverse to the plane, and a received module being fixed in place in the holding state. The base section and the deformation section are formed at least partly of different materials, in any case.

By dissociating the material properties of the base body from those of the deformation section, such a holding frame allows greater flexibility by using suitable combinations of materials.

In the holding frames described in DE 10 2013 113 976 A1, each deformation section is formed by flange parts attached to the outer face of a base frame, the flange parts each having a bending line in their lower end region, at which the flange parts are folded by 180° such that a final edge of the respective flange part is located within the base frame. In order to attach the flange part, the base frame has outer attachment studs which engage into matching attachment recesses when a flange part is attached.

BRIEF SUMMARY

One aim of embodiments of the present application is to provide alternatives to the known holding frames, which specifically allow one or more conventional modules (see implementations of EP 0 860 906 B1, EP 1 801 927 B1 or DE 10 2013 113 976 A1; or also other known modules, see, for example, EP 2 581 991 A1) into the holding frame even when the holding frame has already been installed.

According to one aspect of the invention, a holding frame arrangement for a plug connector for receiving similar and/or different modules is proposed, namely, a holding frame comprising a base frame which defines a plane transverse to an insertion direction of a module into the holding frame arrangement, and which has mutually opposite end faces and mutually opposite side walls, and one or more mounting clips each having two mutually opposite flanges, wherein each of the flanges has a window for receiving a latching lug of a module, and a fixing tab, wherein each mounting clip is adapted to be mounted on a module such that a module fitted with the mounting clip and inserted into the base frame abuts with its latching lugs respective upper edges of the side walls, in the insertion direction, wherein the fixing tabs engage with respective lower edges of the side walls, in the insertion direction, so that the inserted module is fixed in place at least along the insertion direction.

According to another aspect of the invention, a method of populating a holding frame arrangement for a plug connector for receiving similar and/or different modules with a module is proposed, the method comprising attaching a mounting clip comprising two mutually opposite flanges which each have a window for receiving a latching lug of a module and a fixing tab, to the module, such that each latching lug of the module is received in a window of a flange, and inserting the module into a base frame which defines a plane transverse to an insertion direction of the module into the holding frame arrangement, and which has mutually opposite end faces and mutually opposite side walls, wherein the result of insertion is that the latching lugs of the module abut respective upper edges of the side walls, in the insertion direction, and the combined result of attachment and insertion is that the fixing tabs engage with respective lower edges of the side walls, in the insertion direction, such that the inserted module is fixed in place at least along the insertion direction.

Part of the background to these aspects can be found in the following considerations.

In the holding frame known, for example, from DE 10 2013 113 976 A1, flange parts are attached to the outer sides of the base frame, with each of the latching lugs of the modules then entering the latching windows of the flange parts when the modules are inserted into the holding frame. It has now been realized that, by providing the mounting clip(s), it is possible for known modules to be used, without modifications being made to the modules as such, in order to allow modules and (base) frames to be brought together with a certain amount of deformation, associated with fixing in place, on the part of the module (also, at least).

In another advantageous embodiment of one aspect of the present invention, the fixing tabs are designed for elastic deformation between a tensioned state and a relaxed state.

One associated effect of elastic deformation is that, when the force acting on the fixing tab(s) and causing deformation into the tensioned state (e.g., the force acting on the fixing tabs when the module with the flanges attached to the outside thereof is inserted through the inner sides of the side walls), is removed, the fixing tab(s) itself/themselves ensure (s) a return to the relaxed state. However, it may be also be envisaged that the deformation is plastic deformation, as long as sufficient reversibility of that deformation remains assured, to allow a desired number of module insertion/removal cycles.

In another advantageous embodiment of one aspect of the present invention, the base frame, on the one hand, and the mounting clip(s), on the other hand, are made at least partly of different materials.

The base frame and the mounting clip(s) perform different functions in accordance with embodiments of the present invention. The base frame should preferably determine the general stiffness of the holding frame to a substantial extent, whereas the mounting clip(s) should be as easily and preferably elastically deformable as possible. These different functions can be best achieved by selecting separate and appropriate materials for the base frame and the mounting clip(s) largely independently of each other.

In another advantageous embodiment of one aspect of the present invention, the base frame is made at least partly by die casting, in particular of a metal, preferably of zinc or aluminum, or of a metal alloy, preferably of a zinc or aluminum alloy.

Prior art approaches and techniques for producing conventional base frames can also be utilized for base frames used in connection with embodiments of the present invention, providing the shapes of such base frames are geometrically adapted in an appropriate manner.

In another advantageous embodiment of one aspect of the present invention, the flanges are connected to each other.

Connecting the flanges of the mounting clips to each other allows the flanges to be held in place better when the mounting clip or flanges are attached prior to insertion of the module into the base frame.

In another advantageous embodiment of one aspect of the present invention, each flange has at least one latching tab which is adapted for engagement with a lower edge of a module, in the insertion direction.

Using such a latching tab, which interacts with an upper edge of the window in the flange, results in defined positioning of the flange and the module in relation to each other, in the insertion direction, whereby the interaction between a lower edge of the window and the latching lug is not critical in that respect.

In another advantageous embodiment of one aspect of the present invention, the base frame has recesses which extend in the insertion direction from an upper edge of the base frame, in the insertion direction, each of said recesses being adapted to at least partially accommodate a latching lug of a module.

The recesses of the base frame allow the latching lugs to be guided when the module is inserted into the base frame, and by giving the recesses different widths (corresponding to the different widths of the latching lugs), it is possible to have a coding system or reverse polarity protection.

On the other hand, if the upper edge of the base frame is substantially level and the (lower) edge is designed accordingly, the combination of module and mounting clip can still be movable in the longitudinal direction of the base frame after it has been inserted.

In another advantageous embodiment of one aspect of the present invention, the fixing tabs are adapted for engagement with the lower edge of the base frame.

When the fixing tabs are designed to engage with the lower edge of the base frame, this obviates the need to provide an additional edge or recess (with an edge) at which the fixing tabs are engaged.

According to another aspect of the invention, holding frames for a plug connector for receiving similar and/or different modules are proposed, namely, holding frames comprising a base frame which defines a plane transverse to an insertion direction of a module into the holding frame, and which has mutually opposite end faces and mutually opposite side walls, and wherein the side walls of the base frame each have stops for latching lugs of a module, wherein adjacent to at least one stop, the base frame has a portion which protrudes in the opposite direction to the insertion direction and which is provided with a locking member which is pivotable about a pivot axis oriented transversely to the side wall, wherein the locking member is adapted to adopt an insertion position that allows the module to be inserted in the insertion direction into the holding frame, and a holding position in which an inserted module is held by the latching lug of the module between a stop and the locking member.

According to another aspect of the invention, a method of populating a holding frame for a plug connector for receiving similar and/or different modules with a module is proposed, namely, a method comprising inserting the module into a base frame of the holding frame, which defines a plane transverse to an insertion direction of the module into the holding frame and which has mutually opposite end faces and mutually opposite side walls, as far as respective stops on the base frame for latching lugs of the module, wherein adjacent to at least one stop, the base frame has a portion which protrudes in the opposite direction to the insertion direction and which is provided with a locking member which is pivotable about a pivot axis oriented transversely to the side wall, and pivoting the locking member from an insertion position that allows the module to be inserted in the insertion direction into the holding frame to a holding position in which the inserted module is held by the latching lug of the module between the stop and the locking member.

Part of the background to these aspects can be found in the following considerations.

In the holding frames known from EP 0 860 906 B1 and EP 2 581 991 A1, the whole holding frame divided into parts yields to the modules or their latching lugs on insertion, in order to clear a path for the module to a position in which the module can be fixed in place by the holding frame when it returns to its holding state. The holding frames known from EP 1 801 927 B1 and DE 10 2013 113 976 A1 also involve similar yielding, but only of part of the holding frame, which can otherwise remain substantially in its installed state. What these approaches have in common, in any case, is that space is made by yielding outwards, which may mean that more space is commensurately required. The amount of space thus required can be lowered by reducing the thickness of the yielding element, although this means less stability and/or tougher demands with regard to material properties.

It has been realized in connection with embodiments of the present invention that the path for the latching lug of a module can also be cleared by providing a locking member in an insertion position which allows insertion and which is pivoted, after (or during) insertion of the locking member, from the insertion position to a holding position in order to hold the module in place there.

In one advantageous embodiment of one aspect of the present invention, the locking member has a yielding portion which projects into a path of the latching lug in the insertion position and is adapted to yield in such a way, when the latching lug is inserted, that the locking member is pivoted at least partially from the insertion position to the retention position by insertion of the module.

If insertion of the module itself already causes the locking member to transition from the insertion position to the holding position, this has the advantage that there is no need for the user to operate anything separately in that respect. It may also be arranged that inserting the module already causes complete transition from one position to the other, so that no further operation is needed, although it is also possible that, due to the yielding portion yielding to the latching lug of the module, the holding position is not quite reached and/or that securing the holding position requires user action, for example to lock the locking member in place.

In another advantageous embodiment of one aspect of the invention, the holding frame has a blocking member which is adapted to prevent the locking member from pivoting back to the insertion state when the holding frame is in the insertion state.

The blocking member can be realized, for example, by part of the locking member engaging form-fittingly with a matching portion of the base frame. It may be arranged that this form fit, or blocking in general, can not be released again (without destruction), although releasable blocking is preferred in the context of embodiments of the invention.

In another advantageous embodiment of one aspect of the invention, the base frame, on the one hand, and the locking member, on the other hand, are made at least partly of different materials.

The base frame and the locking member(s) perform different functions in embodiments of the present invention. The base frame should preferably determine the general stiffness of the holding frame to a substantial extent, whereas the locking member(s) should be as easily pivoted and if necessary be as elastically deformable as possible. These different functions can be best achieved by selecting separate and appropriate materials for the base frame and the locking member(s) largely independently of each other.

In another advantageous embodiment of one aspect of the present invention, the base frame is made at least partly by die casting, in particular of a metal, preferably of zinc or aluminum, or of a metal alloy, preferably of a zinc or aluminum alloy.

Prior art approaches and techniques for producing conventional base frames can also be utilized for base frames used in connection with embodiments of the present invention, providing the shapes of such base frames are geometrically adapted in an appropriate manner.

According to yet another aspect of the invention, a holding frame for a plug connector for receiving similar and/or different modules is proposed, namely, a holding frame comprising a base frame which defines a plane transverse to an insertion direction of a module into the holding frame, and which has mutually opposite end faces and mutually opposite side walls, and at least two flange parts attached to the side walls of the base frame opposite each other, wherein each flange part extends inside the base frame along an inner face of the base frame in the opposite direction to the insertion direction and beyond an edge of the base frame in the opposite direction to the insertion direction, wherein each flange part has at least one latching window, in the region extending beyond the edge of the base frame, as a latching member for receiving a latching lug of the module, wherein the flange parts are designed to undergo elastic bending and deformation between an insertion state which allows the module to be inserted into the holding frame in the insertion direction, and a holding state in which an inserted module is fixed in place at least along the insertion direction by the latching lug engaging into the latching window, wherein each flange part is in form-locking engagement with the base frame, at least with regard to a relative displacement along the insertion direction, and has at least one clip section extending above a lower edge of the base frame into the base frame, through the base frame and/or around an edge of the base frame, wherein release of the form-locking engagement is prevented by an inserted module.

According to yet another embodiment of the invention, a method of producing a holding frame for a plug connector for receiving similar and/or different modules is proposed, namely, a method comprising providing a base frame which defines a plane transverse to an insertion direction of a module into the holding frame and which has mutually opposite end faces and mutually opposite side walls, attaching at least two flange parts opposite each other to the side walls of the base frame, so that each flange part extends inside the base frame along an inner face of the base frame in the opposite direction to the insertion direction and beyond an edge of the base frame in the opposite direction to the insertion direction, wherein each flange part has at least one latching window, in the region extending beyond the edge of the base frame, as a latching member for receiving a latching lug of the module, wherein the flange parts are designed to undergo elastic bending and deformation between an insertion state which allows the module to be inserted into the holding frame in the insertion direction, and a holding state in which an inserted module is fixed in place at least along the insertion direction by the latching lug engaging into the latching window, and producing a form fit between each flange part and the base frame, at least with regard to a relative displacement along the insertion direction, wherein each flange part has at least one clip section extending above a lower edge of the base frame into the base frame, through the base frame and/or around an edge of the base frame.

According to yet another aspect of the invention, a method of populating a holding frame for a plug connector for receiving similar and/or different modules with a module is proposed, namely, a method comprising providing a holding frame and inserting a module into a base frame of the holding frame, wherein said insertion is between at least two flange parts, wherein said insertion includes elastic bending of the flange parts, which are supported by the base frame, into an insertion state, wherein the method includes elastic deformation of the flange parts back from the insertion state to a holding state, wherein the inserted module is fixed in the holding state at least along the insertion direction by a latching lug of the module engaging into a latching window, wherein release of the form fit between flange parts and the base frame is prevented by an inserted module.

Part of the background to these aspects can be found in the following considerations.

It was realized, in particular, that it is desirable to present a solution which allows a high degree of flexibility in the design of the holding frame, by appropriately selecting the materials for a base frame and flange parts largely independently of each other, and which reduces the probability that the base frame and flange parts formed separately of different materials can detach from each other or that the holding effect of the flange parts is limited or reduced in some other manner.

In order to better prevent an offset arising between an attachment stud and a recess, in an arrangement of the kind shown in document DE 10 2013 113 976 A1, the stud and the recess could be fixed to each other by suitable additional measures, for example by gluing or soldering them together. However, this does not allow fixing by the flange parts to be made tighter as such, and also makes it more complicated to make the holding frame, due to the additional step, which thus entails higher costs.

If the arrangement comprising an attachment stud and an attachment recess, or a similar variant based on the teaching of document DE 10 2013 113 976 A1, were to be moved to the inner face of the base frame, this would prevent the arrangement from being released when the flange parts are opened out, but the result would be a worsening of the fixing tightness, because the flange parts would be even easier to bend due to the longer lever arm (namely as far as the lower edge of the holding frame). In such a variant, a load would also be placed on the region of the flange parts that is bent around the lower edge of the holding frame. When manufacturing by die forming, in particular, material fatigue and thus the failure of the flange parts can be expected to occur more quickly in this region at the lower edge of the holding frame under repeated stress.

On the other hand, tighter fixing in place—with the dimensions of holding frame otherwise being substantially the same—might be achievable by making the flange parts from a stiffer material and/or with a greater material thickness, although that would mean greater effort and expense when producing the flange parts, for example by die forming.

It was realized that greater stability and better fixing of modules in place can be achieved by arranging the flange parts in such a way that they extend on the inner face of the base frame and from there in the opposite direction to the direction in which the modules are inserted. When the flange parts are bent open on insertion of a module, the pivot point or bending point is on the (upper) edge of the base frame and no longer at an arrangement of attachment studs and recesses, or even at the lower edge that has previously been already deformed. Due to the flange part being supported by the base frame when it is being bent open, the amount of spring deflection is kept as short as possible. By its presence, the module being inserted also counteracts the flange part being lifted off the inner face of the base frame, with the result that a relatively small amount of effort is needed when attaching the flange parts to the base frame, without involving any risk of detachment due to deformation of the flange parts.

As the respective module is guided and held by the flange parts, the base frame can also be made shorter by comparison (in the insertion direction). The base frame now holds the flange parts which then hold the modules. However, it is also possible to provide an upper edge of the base frame as a stop for the latching lugs of the modules.

The modules may be received and fixed in place only by the flange parts, which act as spring arms and which are arranged for greater stability and spring force on the inner face of the frame, as a result of which the flange parts have a shorter spring deflection by comparison, thus making the construction "tighter".

The stability is additionally increased by the resilient region of the flange parts being inside the base frame. Furthermore, the pivot and bending point of the material is not in the lower region that is already deformed plastically, but in the middle of the spring steel sheet. This region does not suffer from material fatigue as quickly as the region that is already plastically deformed (bent).

In an advantageous embodiment of one aspect of the invention, the form-locking engagement between the flange part and the base frame is provided by engagement of at least one undercut on and/or in the flange part with at least one undercut on and/or in the inside of the side wall of the base frame, wherein the flange part and the base frame are designed so that a) engagement can be produced and/or released by pivoting the flange part about the edge of the base frame, orb) engagement can be achieved by de-tensioning an elastic deformation of at least a part of the flange part when moving the flange part relative to the base frame in the insertion direction along an inner side of the side wall.

When pivoting the flange part for engagement, advantageous use can be made of the fact that releasing the form-locking engagement would involve pivoting in the opposite direction, although such pivoting is prevented by a module that has been inserted or is in the process of being inserted.

Release of a form fit achieved by displacement, with concomitant elastic deformation, is also prevented by an inserted module, so in that case also there is protection against the form fit being released in a context where such protection is most needed, namely, when the module is being inserted.

In another advantageous embodiment of one aspect of the invention, the flange parts in variant b) above are connected to each other by a web extending along the end face of the base frame, preferably by two webs extending opposite one another along the end faces of the base frame, the outer dimensions of the flange parts, including the web(s) in the plane defined by the base frame, are determined according to the inner dimensions of the base frame.

In particular, the flange parts may be provided in the form of a frame adapted to the inner geometry of the base frame and running around the inside of the latter.

In another configuration variant of one aspect of the invention, the engagement of the undercuts produces a form fit that prevents movement of the flange part relative to the base frame in the opposite direction to the insertion direction, the clip section forming such a form fit with the base frame that movement of the flange part relative to the base frame in the insertion direction is also prevented.

In this variant, form fits are produced in each of two separate areas of the holding frame, each form fit preventing one kind of movement, the direction of those movements running along the direction of insertion and in opposite directions to each other.

In a further variant of the above configuration according to aspect b), the clip section has a guide portion which is guided in a groove and/or a slot in the base frame when the flange part is moved relative to the base frame.

This guidance allows predetermined movement of the flange part along the direction of insertion and also ensures that the flange part contacts the base frame during insertion.

In another advantageous embodiment of one aspect of the invention, the clip section extends into a recess and/or an opening in the side wall of the base frame and fills the recess and/or the opening.

A form fit (and also a material connection and/or a force-fit connection) that can prevent itself from being released when a module is inserted or in the process of being inserted is achieved by holes or the like in the base frame, which are filled by a part of the clip section.

In another advantageous embodiment of one aspect of the invention, the base frame, on the one hand, and the flange parts, on the other hand, are made at least partly of different materials.

The base frame and the flange part(s) perform different functions in the context of the invention. The base frame should preferably determine the general stiffness of the holding frame to a substantial extent, whereas the flange parts should be as easily and preferably elastically deformable as possible. These different functions can be best achieved by selecting separate and appropriate materials for the base frame and the flange part(s) largely independently of each other.

In another advantageous embodiment of one aspect of the invention, the base frame is made at least partly by die casting, in particular of a metal, preferably of zinc or aluminum, or of a metal alloy, preferably of a zinc or aluminum alloy.

Prior art approaches and techniques for producing conventional base frames can also be utilized for base frames used in connection with embodiments of the present invention, providing the shapes of such base frames are geometrically adapted in an appropriate manner.

In another advantageous embodiment of one aspect of the invention, the flange parts are made of a spring steel sheet and/or an elastic plastic.

According to yet another aspect of the invention, a holding frame arrangement for a plug connector for receiving similar and/or different modules is proposed, namely, a holding frame arrangement comprising a base frame which defines a plane transverse to an insertion direction of a module into the holding frame arrangement, and has mutually opposite end faces and mutually opposite side walls, and at least one securing clip which can be attached to the base frame, wherein the base frame has one or more upper edge portions in the side walls, which are provided so that a latching lug of an inserted module comes into contact with it/them, wherein the securing clip has an engagement member at each of its ends, each of which is designed to be brought into engagement with a matching fixing section of the base frame, wherein the securing clip with engagement members that are brought into engagement is to be fastened to the base frame in such a way that one or more latching lugs of inserted modules are held between the edge portion of the base frame and the securing clip, at least with regard to movement in the insertion direction.

According to yet another aspect of the invention, a method of populating a holding frame arrangement for a plug connector for receiving similar and/or different modules with a module is proposed, namely, a method comprising inserting the module into a base frame of the holding frame arrangement, which defines a plane transverse to an insertion direction of the module into the holding frame arrangement, and which has mutually opposite end faces and mutually opposite side walls, wherein as a result of insertion the latching lugs of the module come into contact with respective upper edge portions, in the insertion direction, of the side walls, attaching a securing clip that has an engagement member at each of its ends, wherein as a result of said attachment, both engagement members brought into engagement with a matching fixing section of the base frame, wherein the securing clip with engagement members that are brought into engagement is fastened to the base frame in such a way that one or more latching lugs of the inserted modules are held between the edge portion of the base frame and the securing clip, at least with regard to movement in the insertion direction.

Part of the background to these aspects can be found in the following considerations.

It has been found that it is also possible to fix latching lugs into place with a securing clip that engages with the base frame, and that a suitable design allows the securing clip to be applied easily and quickly.

If a plurality of latching lugs are collectively secured by one securing clip, they are also released collectively. However, a plurality of securing clips may also be provided on each side.

Depending on the design of the securing clip (with regard to the choice of material, for example), a suitable way of attaching it can be chosen, a form fit being specifically preferred here, because if skillfully designed it can be prepared with little effort during production and can be achieved when using the holding frame arrangement.

In another advantageous embodiment of one aspect of the invention, the securing clip is designed to be elastically deformed when attached to the base frame.

Elastic deformation means that when the force acting on the securing clip is removed, a stable situation arises if the securing clip and the base frame are designed accordingly. However, it may be also be envisaged that the deformation is plastic deformation, as long as sufficient reversibility of that deformation remains assured, to allow a desired number of module insertion/removal cycles.

In another advantageous embodiment of one aspect of the invention, the base frame, on the one hand, and the securing clip, on the other hand, are made at least partly of different materials.

The base frame and the securing clip perform different functions in the context of embodiments of the invention. The base frame should preferably determine the general stiffness of the holding frame to a substantial extent, whereas the securing clip should be as easily and preferably elastically deformable as possible. These different functions can be best achieved by selecting separate and appropriate materials for the base frame and the securing clip largely independently of each other.

In another advantageous embodiment of one aspect of the invention, the base frame is made at least partly by die casting, in particular of a metal, preferably of zinc or aluminum, or of a metal alloy, preferably of a zinc or aluminum alloy.

Prior art approaches and techniques for producing conventional base frames can also be utilized for base frames used in connection with embodiments of the present invention, providing the shapes of such base frames are geometrically adapted in an appropriate manner.

In another advantageous embodiment of one aspect of the invention, the base frame has two guide portions each connected to an edge portion and protruding in the opposite direction to the insertion direction and which are designed to guide a latching lug of a module and which fix an inserted module in the longitudinal direction of the base frame by the latching lug.

For one (or also more) module(s), the combination of guide portions and edge portion results in a separate receptacle in the base frame for the respective latching lugs. If, in particular, there are different gaps between the guide portions, a predefined orientation of the modules during insertion can be ensured, so it is possible by virtue of the latter to avoid incorrect orientation and potential problems associated with that.

In another advantageous embodiment of one aspect of the invention, the securing clip is substantially linear between its engagement members. A linear design is very easy to manufacture, so all that needs to be formed are the engagement members (e.g., in the case of a fixing member made of wire). If the fixing sections of the base frame, for example sections protruding in the opposite direction to the insertion direction at or in the respective ends of the side wall or side walls, are holes provided above an upper edge of the inserted latching lugs in order to receive the engagement members, the engagement members may also be linear in design and inserted into the holes in order to fix them in place. Such a hole may also be provided in the form of a slot, similar to a bayonet catch.

Apart from a linear design of at least the middle portion of the securing clip, a shape somewhat similar to a (multiple) square curve may be provided, in which case a latching lug is then received in each of the "rectangular corners" (for example when there is a continuous and linear stop edge).

In another advantageous embodiment of one aspect of the invention, the fixing sections of the base frame are formed in the end faces of the base frame.

According to yet another aspect of the invention, a holding frame for a plug connector for receiving similar and/or different modules is proposed, namely, a holding frame comprising a base frame which defines a plane transverse to an insertion direction of a module into the holding frame, and which has mutually opposite end faces and mutually opposite side walls, and a fixing member which is attached to a side wall of the base frame and is adapted for displacement along a longitudinal direction of the side wall between an insertion state that allows the module to be inserted into the holding frame in the insertion direction, and a holding state in which an inserted module is fixed in place, along the insertion direction at least, by a latching lug of the module and the fixing member, wherein the fixing member has a protrusion extending in the longitudinal direction, which fixes the latching lug of the module when in the holding state, and which is removed from an insertion path of the latching lug when in the insertion state.

According to yet another aspect of the invention, a method of populating a holding frame for a plug connector for receiving similar and/or different modules with a module is proposed, namely a method comprising inserting the module into a base frame which defines a plane transverse to an insertion direction of the module into the holding frame and which has mutually opposite end faces and mutually opposite side walls, wherein a fixing member which is in an insertion state that allows the module to be inserted into the holding frame is mounted on a side wall of the base frame, and moving the fixing the fixing member, when a module is inserted, along a longitudinal direction of the side wall from the insertion state into a holding state in which the inserted module is fixed in place, along the insertion direction at least, by a latching lug of the module and the fixing member, wherein the fixing member has a protrusion extending in the longitudinal direction, which fixes the latching lug of the module when in the holding state, and which is removed from an insertion path of the latching lug when in the insertion state.

Part of the background to these aspects can be found in the following considerations.

It was realized that the geometry of a holding frame allows a fixing member to be attached to the side wall of the base frame in such a way that it can be moved between a holding state and an insertion state without the fixing member preventing insertion of the module when in the insertion state, and without additional space being needed.

In one advantageous embodiment of one aspect of the invention, the fixing member is form-fittingly attached to the inner face or the outer face of the base frame or inside a side wall of the base frame.

As long as the fixing member is attached sufficiently securely, embodiments of the invention are not limited to a specific relative positioning of the fixing member in relation to the side wall, so it may be arranged inside (i.e., in the interior of the holding frame), outside or also in a cavity extending in the insertion direction, for example, inside the side wall, and combinations of the above may also be provided.

In another advantageous embodiment of one aspect of the invention, the base frame, on the one hand, and the fixing member, on the other hand, are made at least partly of different materials.

The base frame and the fixing member(s) perform different functions in the context of embodiments of the invention. The base frame should preferably determine the general stiffness of the holding frame to a substantial extent, whereas the purpose of the fixing member(s) is merely to fix the latching lugs in place. These different functions can be best achieved by selecting separate and appropriate materials for the base frame and the fixing member(s) largely independently of each other.

In another advantageous embodiment of one aspect of the invention, the base frame is made at least partly by die casting, in particular of a metal, preferably of zinc or aluminum, or of a metal alloy, preferably of a zinc or aluminum alloy, whereas the fixing member(s) is/are preferably made of plastic or sheet metal.

Prior art approaches and techniques for producing conventional base frames can also be utilized for base frames used in connection with embodiments of the present invention, providing the shapes of such base frames are geometrically adapted in an appropriate manner.

In another advantageous embodiment of one aspect of the invention, the base frame and/or the fixing member have at least one blocking member that, in the holding state at least, releasably blocks the fixing member by form-locking and/or frictional engagement. Such blocking prevents inadvertent release of the holding state better.

Features of advantageous embodiments of the subject matter of the present application are defined in the claims and one who is skilled in the art can also find other advantageous features, embodiments and variants of the invention in the above description and the discussion below.

BRIEF DESCRIPTION OF THE SEVERAL VIEWS OF THE DRAWINGS

In the following, the subject-matter of the present application shall be illustrated and described with reference to the embodiments shown in the Figures, in which.

In the enclosed drawings and in the associated descriptions of said drawings, corresponding or related elements are given corresponding or similar reference signs, where expedient, even when they are to be found in different embodiments.

DETAILED DESCRIPTION

Figure 1:
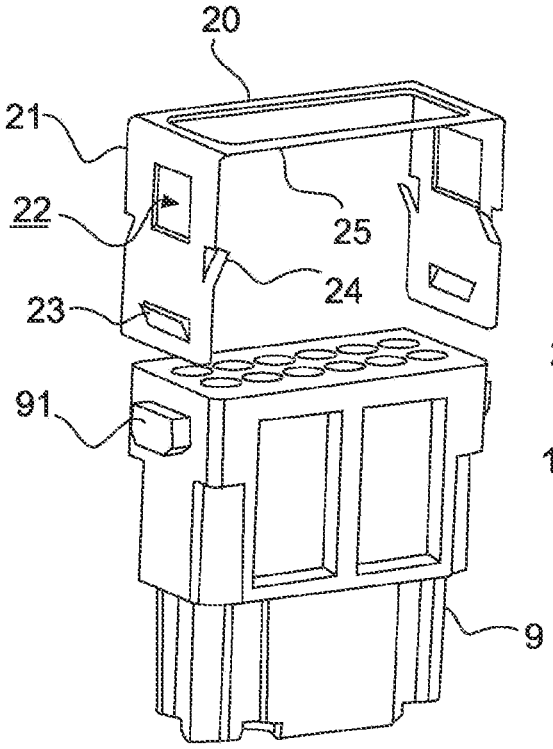
FIG. 1 shows a mounting clip of a holding frame arrangement according to a first embodiment, together with a module.

FIG. 1 shows a mounting clip 20 of a holding frame arrangement 1 according to a first embodiment, together with a module 9.

Module 9 is a conventional module as already known, for example, from the implementations of the teachings of EP 0 860 906 B 1, EP 1 801 927 B1 or DE 10 2013 113 976 A1, whereby the invention can also be used with other, similar modules if configured accordingly, for example as shown in EP 2 581 991 A1. The module 9 shown here has two latching lugs 91 provided in the conventional manner on the end faces of the module and having different widths to ensure clear orientation.

Mounting clip 20 includes two flanges 21 that are spaced so far apart that they can receive module 9 between them with little play, and with latching lugs 91 received in a respective window 22 of flanges 21. At their ends (in the insertion direction), flanges 21 each have a fixing tab 23 extending outwards in the opposite direction to the insertion direction. Each flange 21 also has two latching tabs 24 extending inwards in the opposite direction to the insertion direction, just below window 22 and on the outer sides of flange 21. The flanges 21 of mounting clip 20 are connected to each other by two connecting webs 25 that extend in such a manner in the longitudinal direction of module 9 that the interior of module 9, i.e., the area in which lines (not shown), or similar, of module 9 run, is not blocked.

In the embodiment shown, mounting clip 20 is provided for module 9 only, but it shall be understood that embodiments of the invention are not limited to that, as it is also possible for a plurality of modules 9 to be joined together with a single mounting clip.

Figure 2:
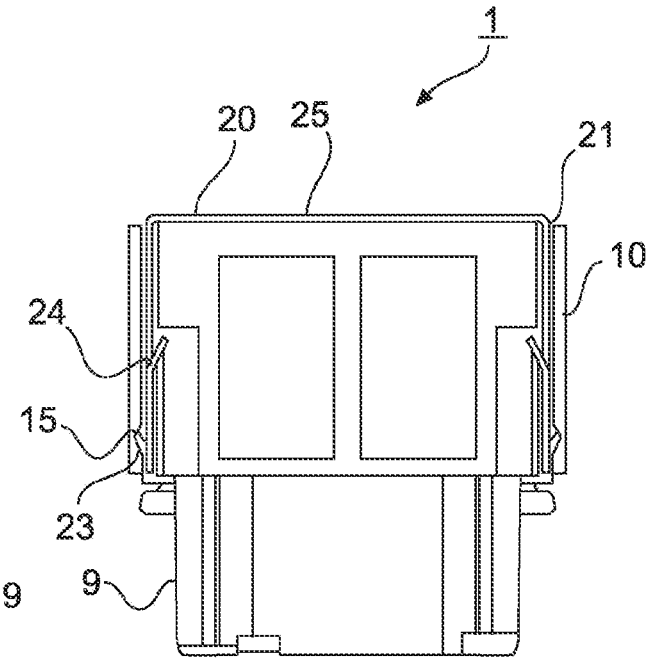
FIG. 2 shows a partial cross-sectional view of a holding frame arrangement according to the first embodiment, with an inserted module and a mounting clip attached thereto.

FIG. 2 shows a partial cross-sectional view of a holding frame arrangement 1 according to the first embodiment, with an inserted module 9 and a mounting clip 20 attached thereto.

As already explained with reference to FIG. 1, mounting clip 20 has two flanges 21 with a fixing tab 23 and latching tabs 24, with flanges 21 being connected to each other along the longitudinal direction of module 9.

Figure 3:
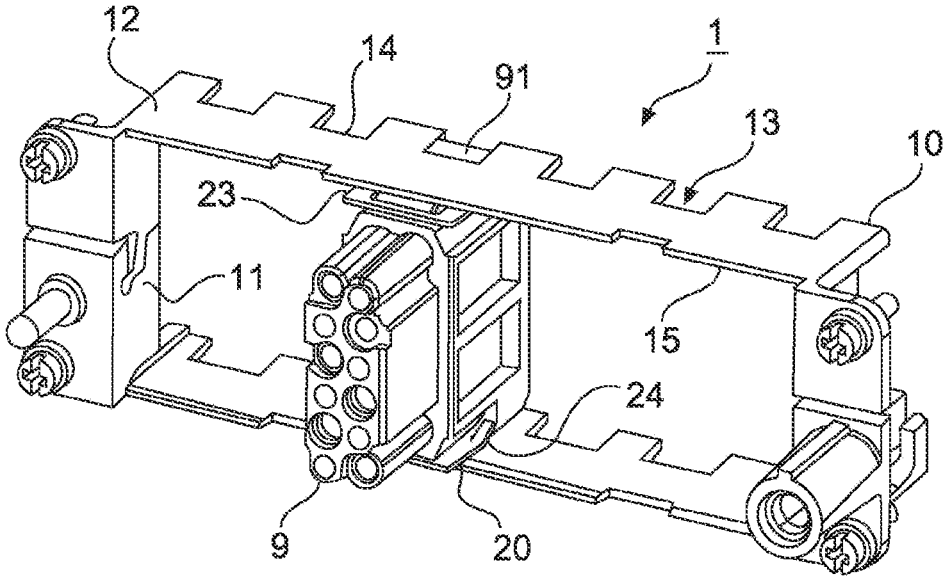
FIG. 3 shows a perspective view of a holding frame arrangement according to the first embodiment, with an inserted module and a mounting clip attached thereto.

Mounting clip 20 is shown here in a state in which it is mounted on module 9, the combination of module 9 and mounting clip 20 being inserted into a base frame 10 of holding frame arrangement 1 and fixed in place therein, as shown in FIG. 3.

Fixing tabs 23 extend outwards in the opposite direction to the insertion direction and are in engagement with a bottom edge 15 of base frame 10. Latching tabs 24 extend inwards in the opposite direction to the insertion direction and are each in engagement with an edge on the outer side of the module 9 (see also FIG. 1).

FIG. 3 shows a perspective view of a holding frame arrangement 1 according to the first embodiment, with an inserted module 9 and a mounting clip 20 attached thereto.

In the view shown in FIG. 3, holding frame arrangement 1 and module 9 are shown in a direction oblique and opposite to the insertion direction.

The base frame 10 of holding frame arrangement 1 has two mutually opposite end faces 11 and two mutually opposite side walls 12.

Side walls 12, which are configured here to receive six individual modules (or a corresponding number of double or multiple modules), each have recesses 13 at matching places, the width of recesses 13 matching the width of the respective latching lug 91 of module 9.

At the lower end of each recess 13, base frame 10 has an edge 14 which the latching lug 91 of module 9 abuts in the inserted state.

In FIG. 3, an inserted module 9 is shown in combination with the corresponding mounting clip 20, and it can be seen how fixing tabs 23 abut the lower edge 15 of base frame 10 and how the latching tabs 24 abut module 9.

Base frame 10 is similar in design to a frame as described in EP 0 860 906 B1 and can be hinged open after removal to allow a module 9 to be removed along with mounting clip 20. Unlike the base frame known from EP 0 860 906 B1, however, the material of side walls 12 is thinner (to make space for mounting clip 20), and recesses 13 differ from the latching windows of EP 0 860 906 B1 in that the upper boundaries are left out (so that the latching lug 91 of module 9 can be inserted into an installed base frame 10).

In the embodiment discussed here, mounting clip 20 is located, in the mounted and inserted state, with each flange 21 between module 9 and a side wall 12 of the base frame 10. However, it is also possible for the mounting clip and the base frame to be designed in such a way that the flanges are disposed outside the base frame, in which case the edge and the upper edge of the window fix the module in place, and due to the flanges being on the outside, the fixing tabs each point inwards. The mounting clip can also be partly inside and partly outside the base frame.

Figure 4:
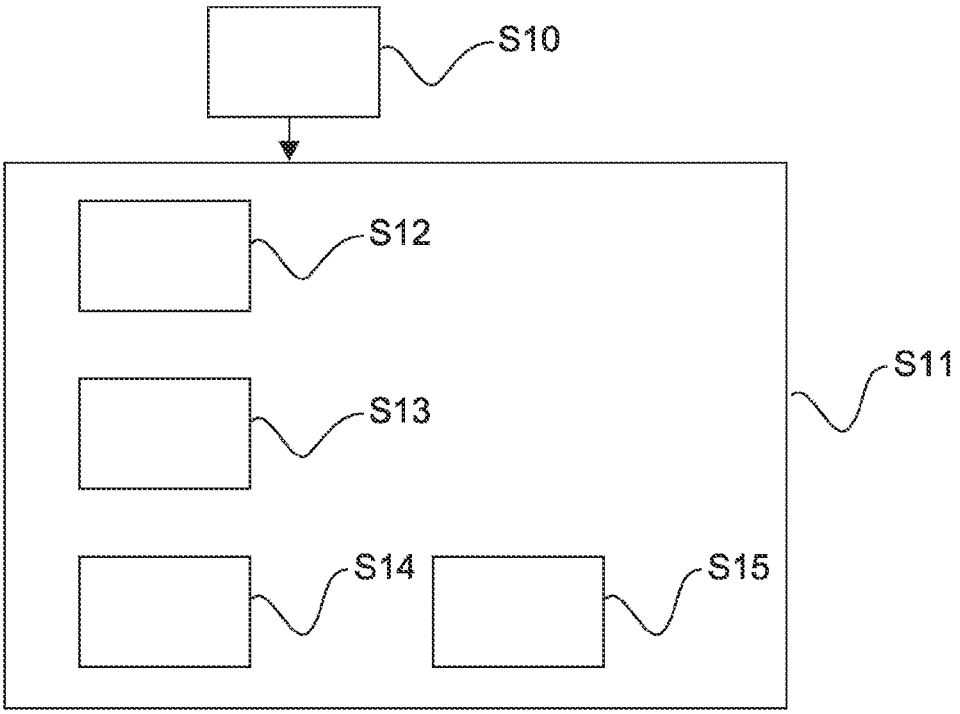
FIG. 4 shows a schematic flow diagram of an embodiment of the method according to the invention of populating the holding frame arrangement of the first embodiment with a module.

FIG. 4 shows a schematic flow diagram of a method of populating a holding frame with a module according to an embodiment of the invention.

In step S10, the mounting clip is attached to the module such that each latching lug of the module is received in a window of a flange of the mounting clip.

In step S11, the module, with a mounting clip attached thereto, is inserted into the base frame.

During insertion step S11, the fixing tabs of the mounting clip are deformed such that they are substantially flush with the other parts of the flanges.

During at least part of insertion step S11, the latching lugs of the module are also guided by the boundaries of the recesses in the side walls (step S13).

The latching lugs finally abut (step S14) the edge of the base frame (lower boundary of the recesses), and at substantially the same time, in step S15, the fixing tabs are released, relax and engage with the lower edge of the base frame such that the inserted module is fixed along the insertion direction by the respective upper edges of the windows and by the edges of the base frame and in the longitudinal direction by the recesses in the base frame.

In this embodiment, the mounting clip is firstly attached to the module, and then the combination of module and mounting clip is inserted into the base frame. However, it is also possible, generally speaking, to firstly insert the module into the base frame, followed by inserting the mounting clip to fix the module in place in the base frame, with the flanges of the mounting clip then running between the module and the base frame, or outside the base frame. In the case of flanges that run on the inside, it is then necessary to lengthen the window in the flange to its lower edge to allow the latching lug to pass. Flanges that run on the outside obviate the need for such lengthening by bending the mounting clip accordingly.

Figure 5:
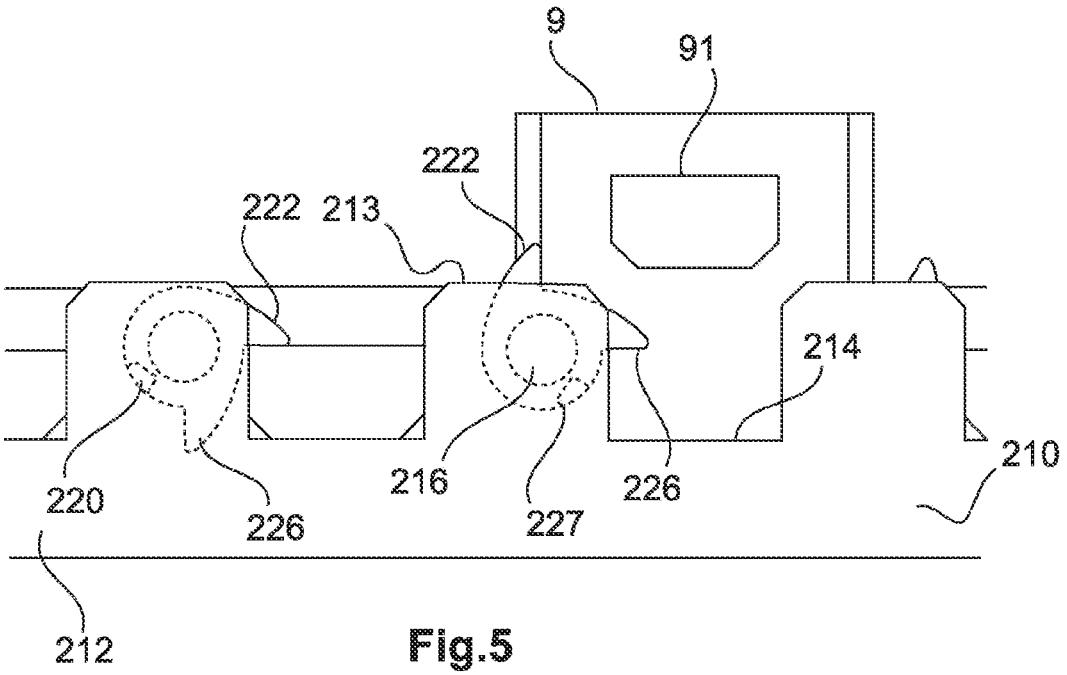
FIG. 5 shows a partly transparent side view of a part of a holding frame according to a second embodiment.
Figure 6:
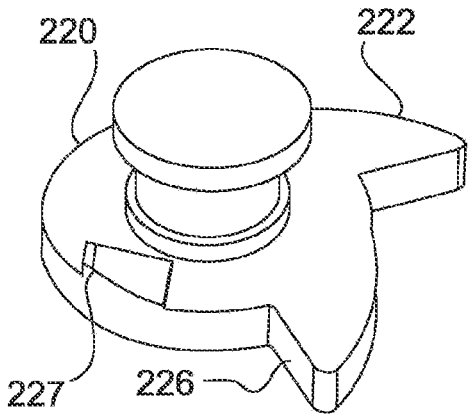
FIG. 6 shows a locking member according to the second embodiment.
Figure 7:
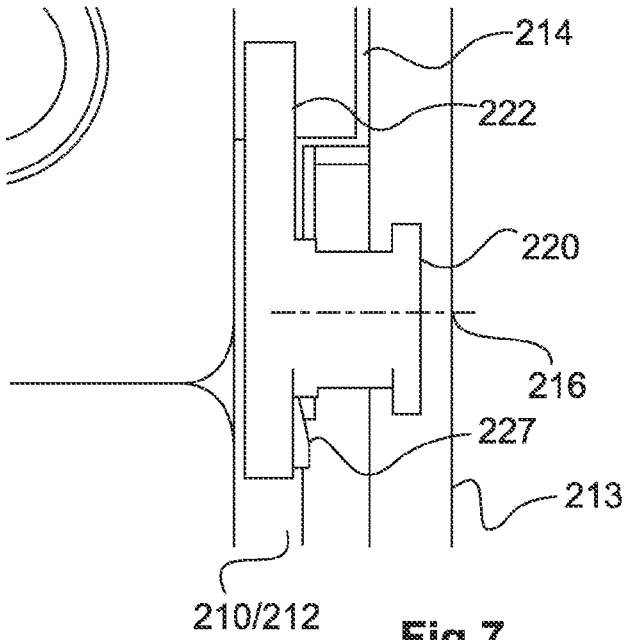
FIG. 7 shows a partly transparent top view onto a part of the holding frame shown in FIG. 5.

FIG. 5 shows a partly transparent side view of a part of a holding frame 2 according to a second embodiment, FIG. 6 shows a locking member 220 of the second embodiment, and FIG. 7 shows a partly transparent top view onto a part of the holding frame 2 shown in FIG. 5.

Holding frame 2 has a base frame 210 that is shown here only in part, except for what will become clear in the following, but which is similar to a base frame as described in the other embodiments.

The base frame 210 has end faces (not shown here) and side walls 212, side walls 212 having a plurality of stops 214 for a lower edge of a latching lug 91 of a module 9. Protruding portions 213 that extend in the opposite direction to the insertion direction from the level of stops 214 are located beside and between stops 214 and are spaced apart by a distance equal to the width of latching lug 91.

A bearing for a locking member 220, that receives locking member 220 in such a way that it is rotatable or pivotable about a pivot axis 216 perpendicular to the plane of side wall 212, is provided in a respective protruding portion 213.

Differently from this embodiment, respective locking members may be provided opposite one another in two protruding portions that enclose a stop region and are thus neighboring portions, in which case they are provided mirror-invertedly to each other.

The locking members 220 shown in FIGS. 5, 6 and 7 each have a holding portion 222 and a yielding portion 226 arranged offset from each other about the pivot axis by an angle of approximately 90°.

The right-hand part of FIG. 5 shows locking member 220 in an insertion state, in which yielding portion 226 projects into the region above stop 214.

If a module 9 is inserted into holding frame 2 with latching lug 91 between the protruding portions 213, yielding portion 226 is moved so that locking member 220 is pivoted. If yielding portion 226 is shaped accordingly, the action of latching lug 91 on yielding portion 226 can be continued until latching lug 91 abuts stop 214.

The left-hand part of FIG. 5 shows locking member 220 in a holding state. Due to locking member 220 pivoting when latching lug 91 is inserted, holding portion 222 stops above latching lug 91 such that holding portion 222 and stop 214 enclose the latching lug 91 between each other.

In addition to holding portion 222 and yielding portion 226, locking member 220 has a blocking member 227 that engages with base frame 210 when the holding state is adopted, and by way of a form fit prevents locking member 220 from pivoting back again.

In the installed state, locking member 220 is pretensioned by a spring (not shown) along pivot axis 216 (for example to the right in the view shown in FIG. 7 (outwardly from the perspective of holding frame 2), and if a user exerts an external force against the spring, blocking member 227 can be disengaged from the base frame 210 such that the locking member 220 can be brought from the holding state into the insertion state.

Figure 8:
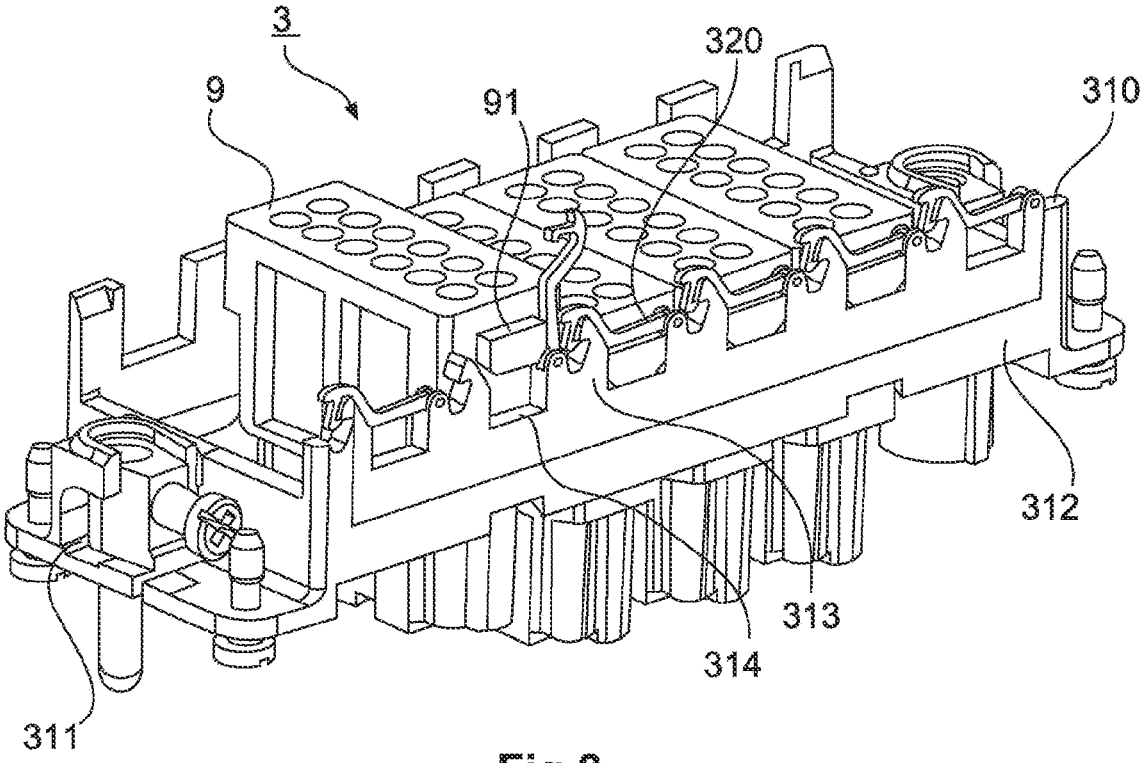
FIG. 8 shows a perspective view of a holding frame according to a third embodiment, with modules.
Figure 9:
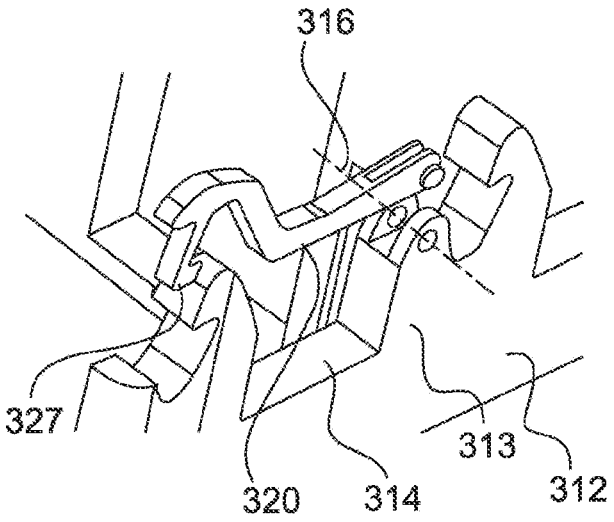
FIG. 9 shows an exploded view of part of the holding frame shown in FIG. 8.

FIG. 8 shows a perspective view of a holding frame 3 of a third embodiment, with modules 9, and FIG. 9 shows an exploded view of part of the holding frame shown in FIG. 8.

Holding frame 3 comprises a base frame 310 that has end faces 311 and side walls 312. Side walls 312 are provided with a plurality of stops 314, each located between two neighboring portions 313 projecting in an opposite direction to an insertion direction relative to stops 314. For each stop 314, one of the respective protruding portions 313 is fitted with a locking member 320 that is pivotable about a pivot axis 316 that is perpendicular to a plane defined by the respective side wall 312.

Locking element 320 can adopt at least one insertion state here, in which it frees the path to stop 314, through and past protruding portions 313, for a latching lug 91 of a module 9 to be inserted, a holding state also being provided in which locking member 320, in combination with stop 314, encloses and fixes latching lug 91 of module 9. In the inserted state, locking member 320, which is held in place at pivot axis 316, is also latched via a blocking member 327, in the form of an engagement hook, to the opposite protruding portion 313.

In the third embodiment (and also in the variant discussed below), a locking member 320 fixes a latching lug 91 in place, whereby embodiments of the invention can also be realized in such a way that a locking member fixes several latching lugs in place.

In the region of pivot axis 316, locking member 320 has two tongues provided with protuberances that extend into respective holes in protruding portion 313. The protuberances are released from the holes by pressing the tongues together, thus allowing locking member 320 to be replaced.

Figure 11:
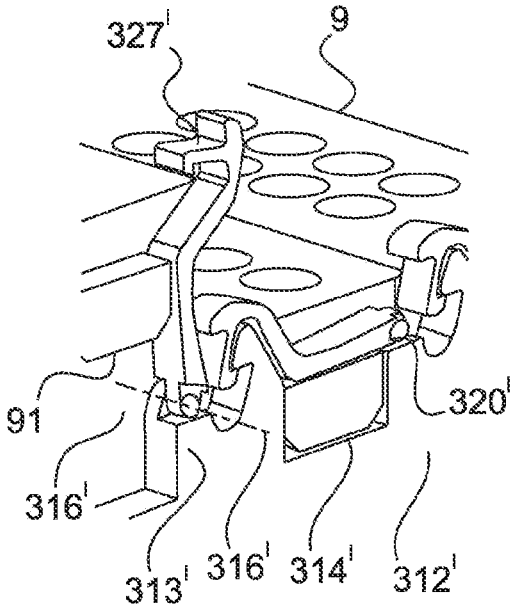
FIG. 11 shows a detail of the view shown in FIG. 10.
Figure 10:
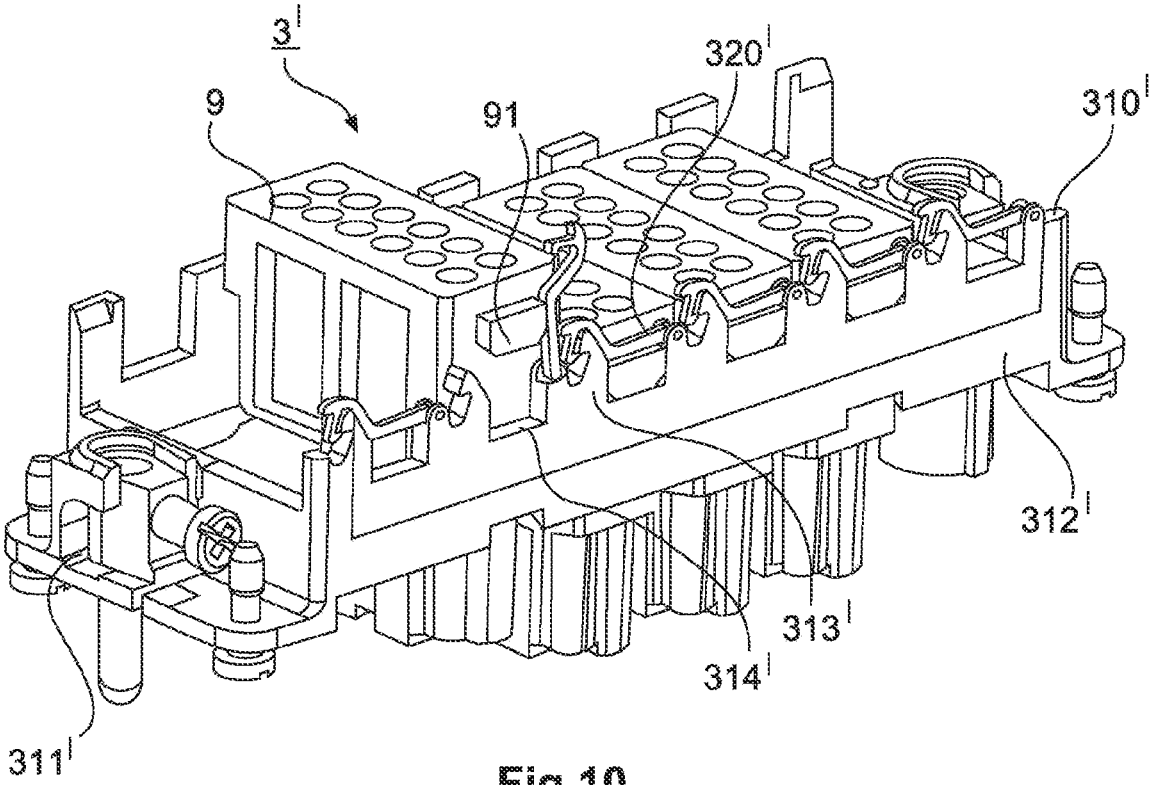
FIG. 10 shows a perspective view of a holding frame according to a variant of the third embodiment.

FIG. 10 shows a perspective view of a holding frame 3' according to a variant of the third embodiment, and FIG. 11 shows a detail of the view shown in FIG. 10.

Like holding frame 3 in the third embodiment, holding frame 3' has a base frame 310' with end faces 311' and side walls 312'. Side walls 312' are the same—except for what is described in the following—as side walls 312 in the third embodiment as discussed above, and like the aforementioned have stops 314' and protruding portions 313'.

Locking elements 320' pivotable about a pivot axis 316', with locking members 327' in the form of engagement hooks, are likewise provided.

Unlike locking members 320 in FIGS. 8 and 9, locking member 320' is attached non-releasably to base frame 310'. The connection is formed in this case by riveting, although other options may also be used.

Figure 12:
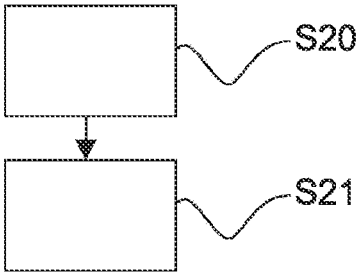
FIG. 12 shows a schematic flow diagram of an embodiment of the method according to the invention of populating a holding frame according to the second or third embodiment with a module.

FIG. 12 shows a schematic flow diagram of a method according to an embodiment of the invention of populating a holding frame according to the second or third embodiment with a module.

The method includes a step S20 in which the module is inserted into the base frame of the holding frame as far as respective stops on the base frame for latching lugs of the module. The method also includes step S21 of pivoting the locking member, provided pivotably about a pivot axis transverse to the side wall of the base frame on a portion of the base frame protruding in the opposite direction to the insertion direction, from an insertion position that allows the module to be inserted into the holding frame in the insertion direction, to a holding position in which the inserted module is held by the latching lug of the module between the stop and the locking member.

In the second embodiment, pivoting is at least simultaneous with insertion and is also caused by insertion itself, although pivoting may also be performed separately after (full) insertion.

Figure 13:
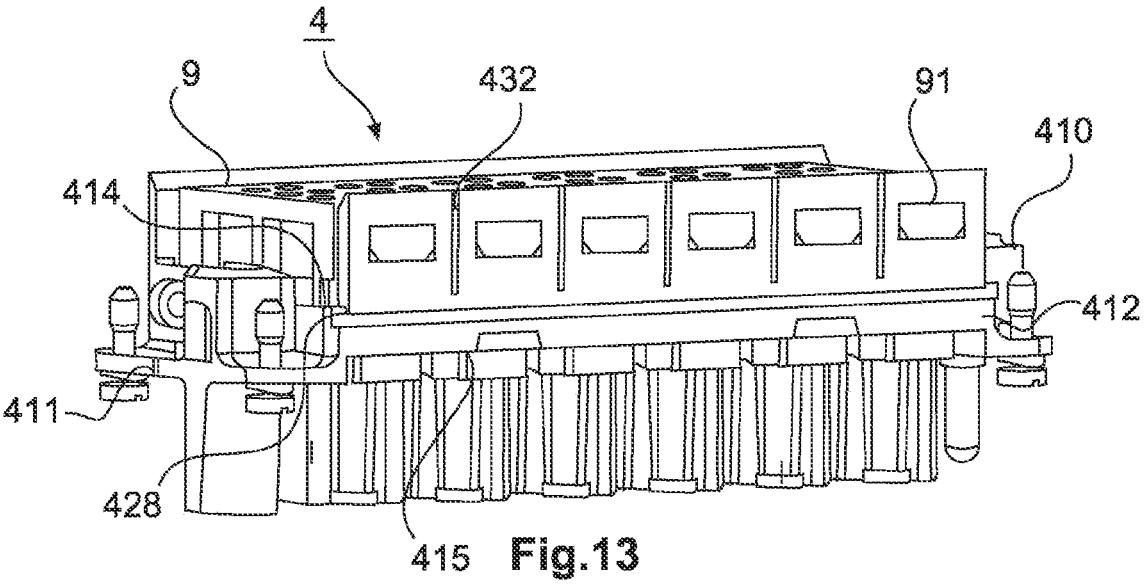
FIG. 13 shows a perspective view of a holding frame according to a fourth embodiment, with modules inserted.
Figure 14:
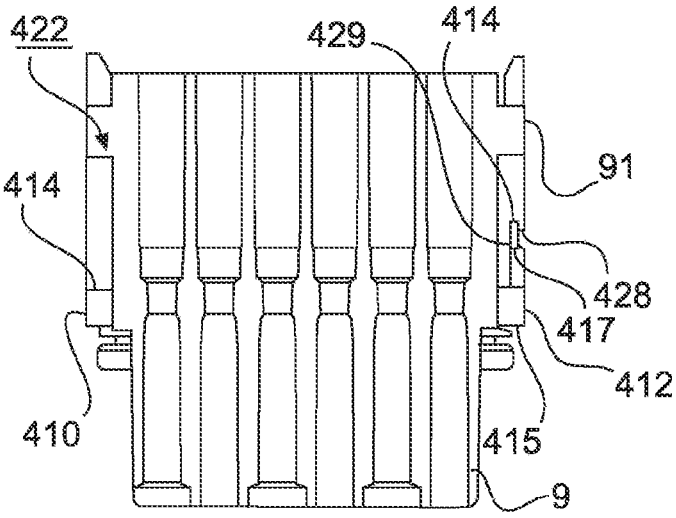
FIG. 14 shows a cross-sectional view of the holding frame with modules as shown in FIG. 13.
Figure 15:
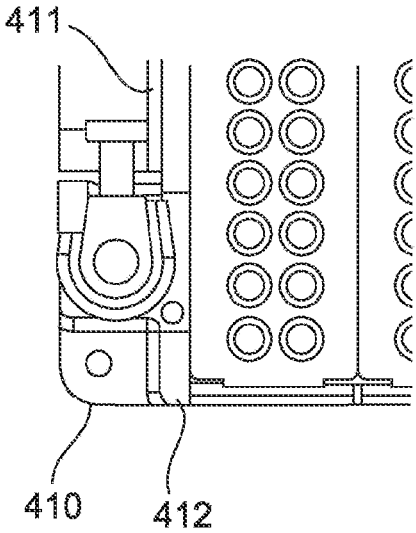
FIG. 15 shows a top view of part of the holding frame with modules as shown in FIG. 13 and FIG. 14.

FIG. 13 shows a perspective view of a holding frame 4 according to a fourth embodiment, with inserted modules 9, whereas FIG. 14 shows a cross-sectional view of holding frame 4, with modules 9 as shown in FIG. 13, and FIG. 15 shows a top view onto part of holding frame 4, with modules 9 as shown in FIG. 13 and FIG. 14.

Holding frame 4 comprises a base frame 410 and flange parts 420 attached thereto.

Base frame 410 has two mutually opposite end faces 411 and two mutually opposite side walls 412.

In the views shown in FIGS. 13 to 15, modules 9 are plugged or inserted into holding frame 4 and extend through base frame 410 in the insertion direction (from top to bottom in FIG. 13 and FIG. 14).

In this embodiment, flange parts 420 are configured for six (individual) modules 9, although other numbers of modules may also be provided. It is possible, for example, for two modules to be inserted beside each other on either side, which are each designed for three modules—with capacity otherwise remaining the same. It is also possible to provide a separate flange portion for each module or each module slot. As in the other holding frames, it is also possible to insert modules into the holding frame of this embodiment that have a greater width (in the longitudinal direction of the holding frame), for example, modules that are fitted with two latching lugs on either side and are twice as wide as a single module.

Modules 9 are each received here with their latching lugs 91 in latching windows 422 of flange parts 420. Flange parts 420 are each held in place on base frame 410 and themselves hold modules 9 in place, by way of latching windows 422, so that modules 9 are fixed in place along the insertion direction. Modules 9 are fixed in the longitudinal direction of holding frame 4 by designing latching windows 422 accordingly, with modules 9 being fixed in position in their own longitudinal direction by the space between opposite flange parts 420.

The respective latching windows 422 in opposite flange parts 420 are also configured differently from each other, windows 422 are also configured differently to those in opposite flange parts 420, thus resulting in a form of coding for modules 9 that thus provides clear orientation for insertion (and orientation when fixing in place).

Flange parts 420 are each provided with slots 432 between latching windows 422, thus allowing each resultant tab to be bent open largely independently of neighboring tabs in order to allow a module 9 to be separately inserted or removed.

As can be seen from FIG. 14, in particular, flange parts 420 each have at least one clip section 428 extending here around an upper edge 414 of base frame 410, with flange part 420 itself extending completely above a lower edge 415 of base frame 410.

In addition to clip section(s) 428, each flange part 420 has one or more undercuts 429 located here on the outside of flange part 420, i.e., facing the inner side of base frame 410, the inner wall likewise having an undercut 417 at the respective position.

If flange part 420 is slightly tilted when assembling holding frame 4 (for example in the clockwise direction in the case of the right-hand flange part 420 in FIG. 14), with clip section 428 abutting the (upper) edge 414 of base frame 410, and pivoted in such a way (in counter-clockwise direction in the case of the right-hand flange part 420 in FIG. 14) that it stops at the inner side of base frame 410, undercuts 417, 429 engage each other so that flange part 420 is thus secured against any movement in the opposite direction to the insertion direction. Clip section 428 holds flange part 420 to base frame 410, thus allowing holding frame 4 to be handled.

If a module 9 is inserted into the holding frame 4 produced in this manner, its lower region ensures that the form fit between undercuts 417, 429 is secured, as module 9 connects each flange part 420 to the inner side of base frame 410. For that reason, the form fit is not released even when flange part 420 is deformed in the region of a latching window 422 during insertion of module 9, to allow latching lug 91 of module 9 to pass through at the level of latching window 422.

As can be seen from the left-hand part of FIG. 14, it is necessary for the elements of undercuts 417, 419 and of clip section 428 to extend over the entire flange part 420 in its longitudinal direction.

In particular, it can be seen from FIGS. 14 and 15 that the end faces of module 9 abut the inner sides of flange parts 420.

Figure 16:
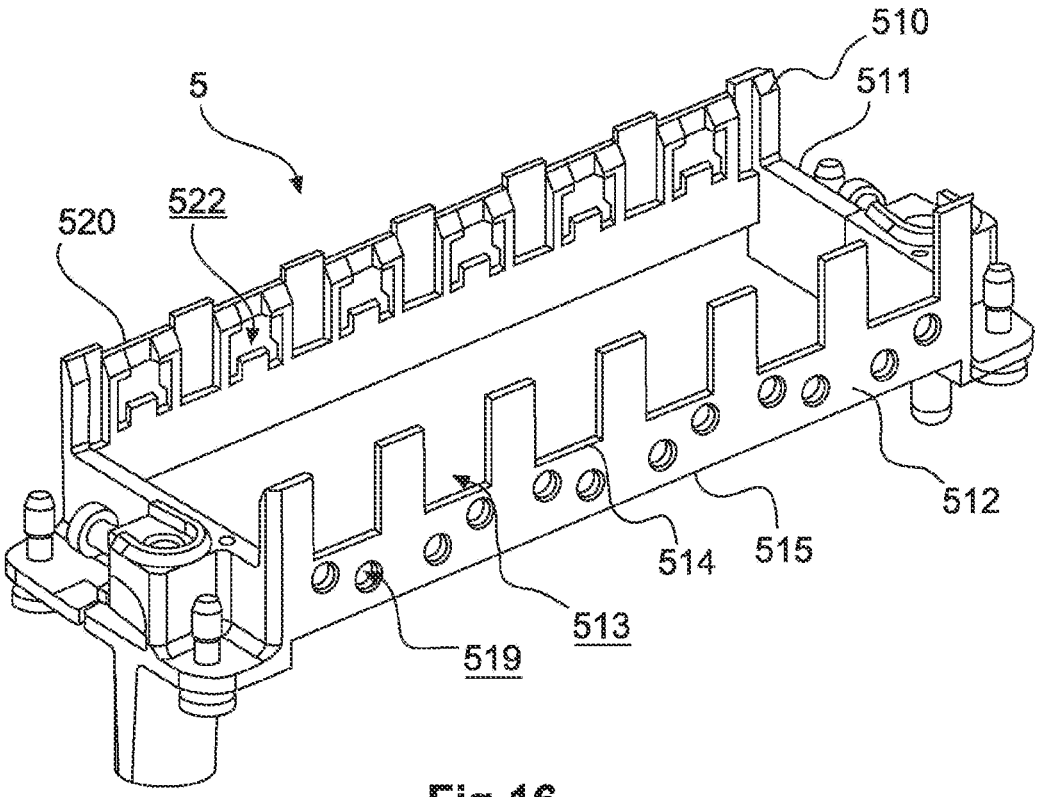
FIG. 16 shows a perspective view of a partly assembled holding frame according to a fifth embodiment.
Figure 17:
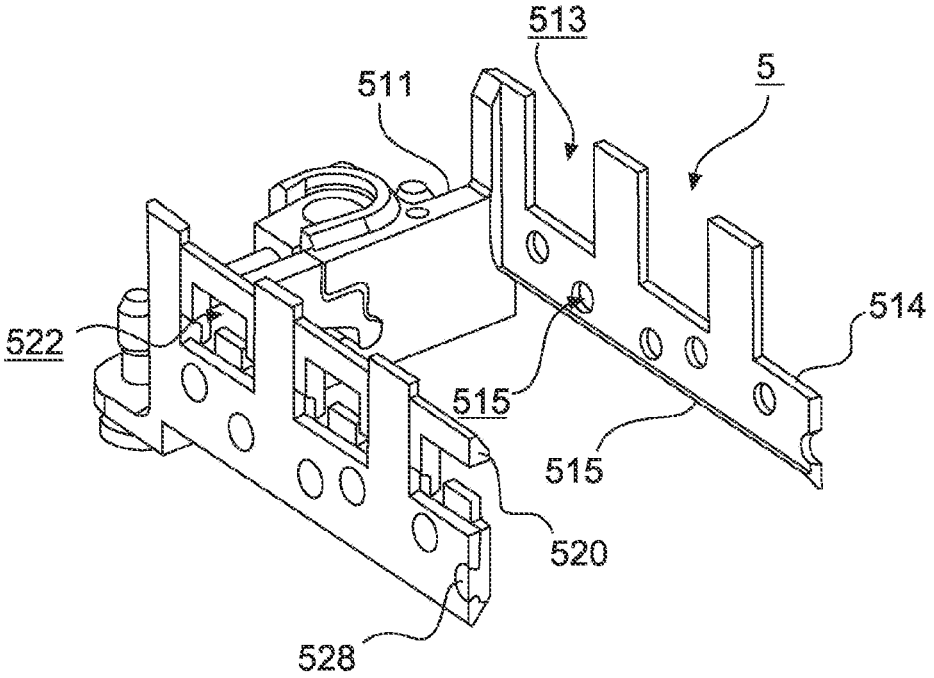
FIG. 17 shows a perspective cross-sectional view of the holding frame shown in FIG. 16.

FIG. 16 shows a perspective view of a partly assembled holding frame 5 according to a fifth embodiment, and FIG. 17 shows a perspective cross-sectional view of the holding frame 5 shown in FIG. 16.

Holding frame 5 has a base frame 510 with mutually opposite end faces 511 and mutually opposite side walls 512. Base frame 510 also has a plurality of recesses 513, each of which roughly defines a region into which a latching lug of a module (not shown) comes to rest in the inserted state. Each of the recesses has an edge 514 at its lower end. In this embodiment, side wall 512 has a plurality of through openings 519 in the form of holes in the area between edge 514 and a lower edge 515 of side wall 512.

In FIGS. 16 and 17, holding frame 5 is only partly assembled, in that only one flange part 520 is present, which means that one side wall 512 is not yet fitted with a respective flange part.

Flange part 520 has a plurality of latching windows 522, each of which is provided to receive a latching lug of a module. The area of flange part 520 surrounding latching window 522 is matched to the size of recess 513 adjacent to it, such that flange part 520 can be bent outwards with this area into the region of recess 513 when a module is inserted.

Flange part 520 also has a plurality of clip sections 528 that fit the openings 519 in base frame 510 and which extend through said openings 519 when flange part 520 is mounted on base frame 510. If flange part 520 is made of a thermoplastic plastic, for example, clip sections 528 can be fused onto it, thus forming an intimate bond between flange part 520 and base frame 510.

In the fifth embodiment also, it is possible to insert double or multiple modules, and coding by way of differently designed latching windows is likewise possible.

Figure 18:
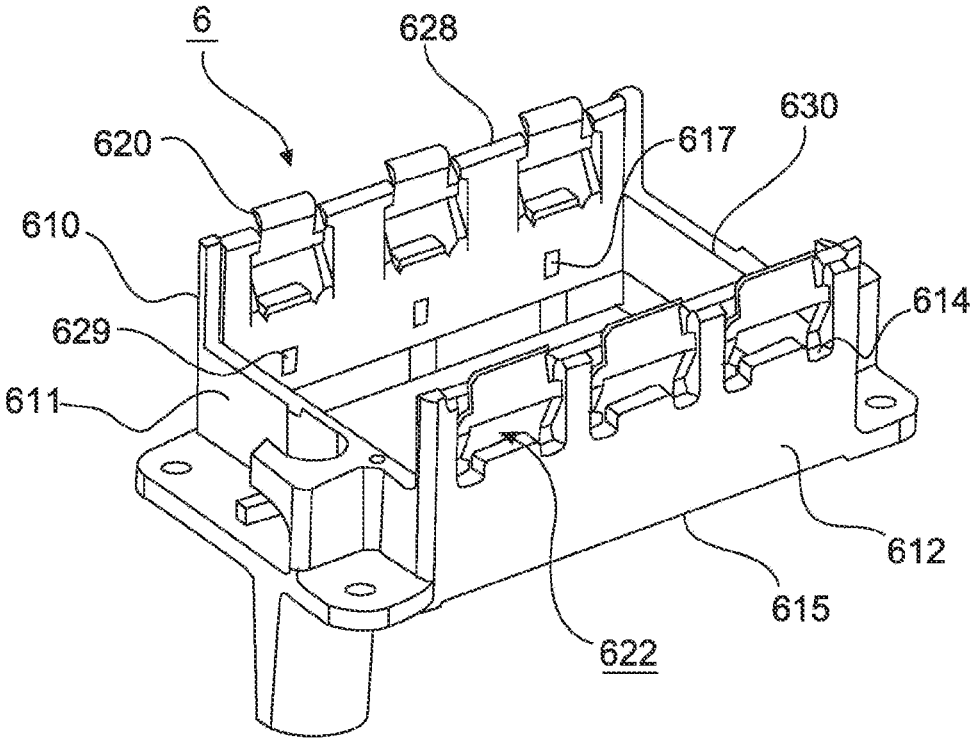
FIG. 18 shows a perspective view of a holding frame according to a sixth embodiment.
Figure 19:
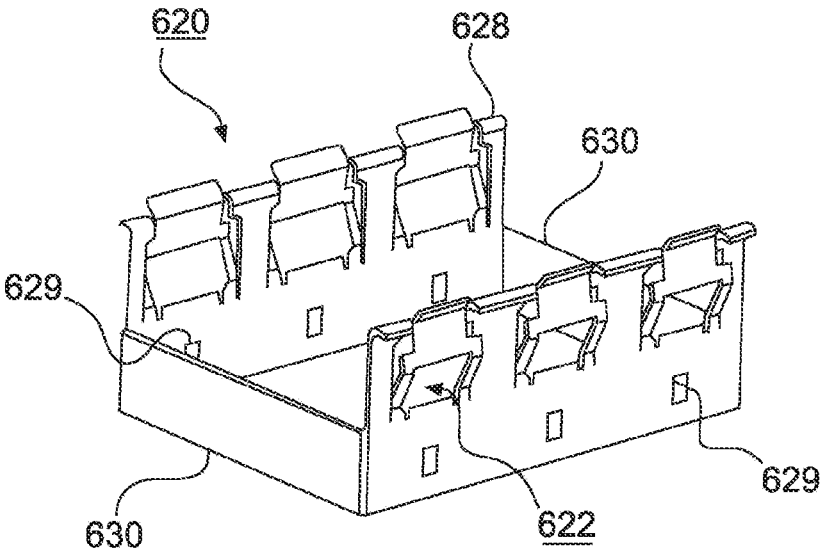
FIG. 19 shows a perspective view of the flange parts of the holding frame shown in FIG. 18.
Figure 20:
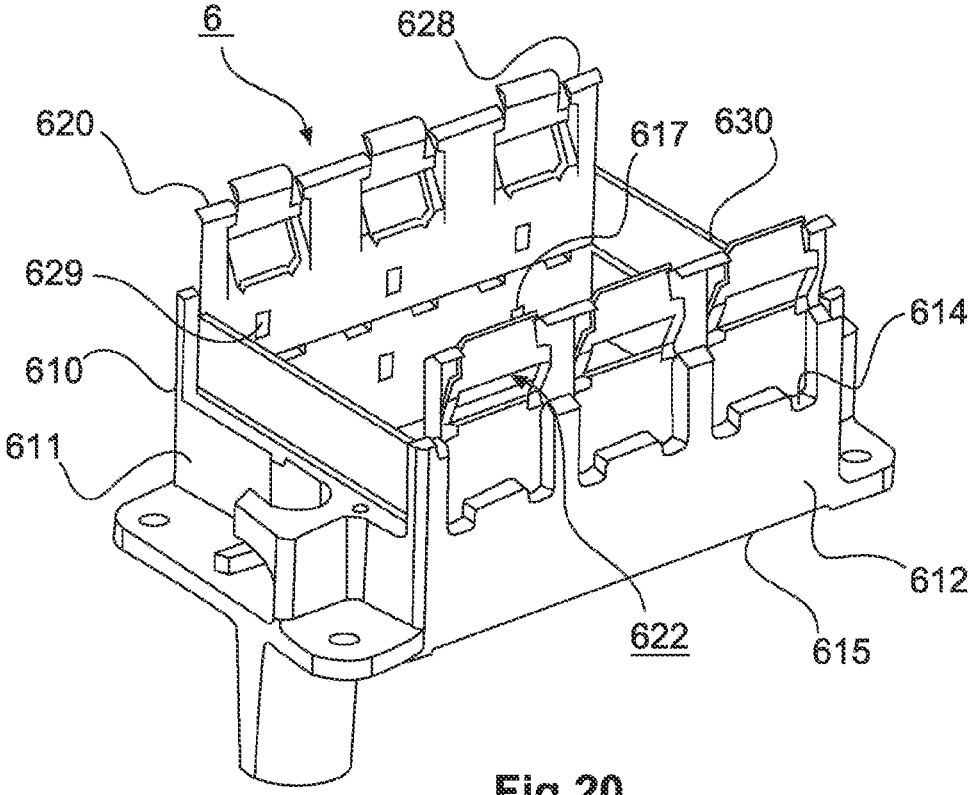
FIG. 20 shows a view of the holding frame of FIG. 18, with flange parts partly inserted into the base frame.

FIG. 18 shows a perspective view of a holding frame 6 according to a sixth embodiment. FIG. 19 shows a perspective view of flange parts 620 of the holding frame 6 shown in FIG. 18, and FIG. 20 shows a view of the holding frame 6 shown in FIG. 18 with flange parts 620 partly inserted into a base frame 610 thereof.

The holding frame 6 includes a base frame 610 and an inner frame formed by flange parts 620 and webs 630.

Base frame 610 has mutually opposite end faces 611 and mutually opposite side walls 612. In an inner region between a lower edge 615 (in the insertion direction) and an upper edge 614, the base frame 610 also has undercuts 617 in the form of protrusions.

Flange parts 620 are arranged opposite each other and are connected to each other by webs 630. Corresponding to the undercuts 617 on base frame 610, each flange part 620 has undercuts 629 in the form of openings.

Above the respective edge 614, each flange part 620 is provided with a respective latching window 622 for receiving a latching lug of a module (not shown). The areas around latching window 622 are flexible and allow deformation, supported by edge 614, in order to allow a latching lug to pass through.

Between the regions around latching window 622, each flange part 620 also has clip sections 628 that clamp around a respective edge portion on the top side of base frame 610, thus preventing any displacement of flange parts 620 in the insertion direction. In the installed state, flange parts 620 do not extend beyond the lower edge 615 of base frame 610.

When modules are inserted into holding frame 6, the position of flange parts 620 at the inner wall of base frame 610 is thus stabilized.

Figure 21:
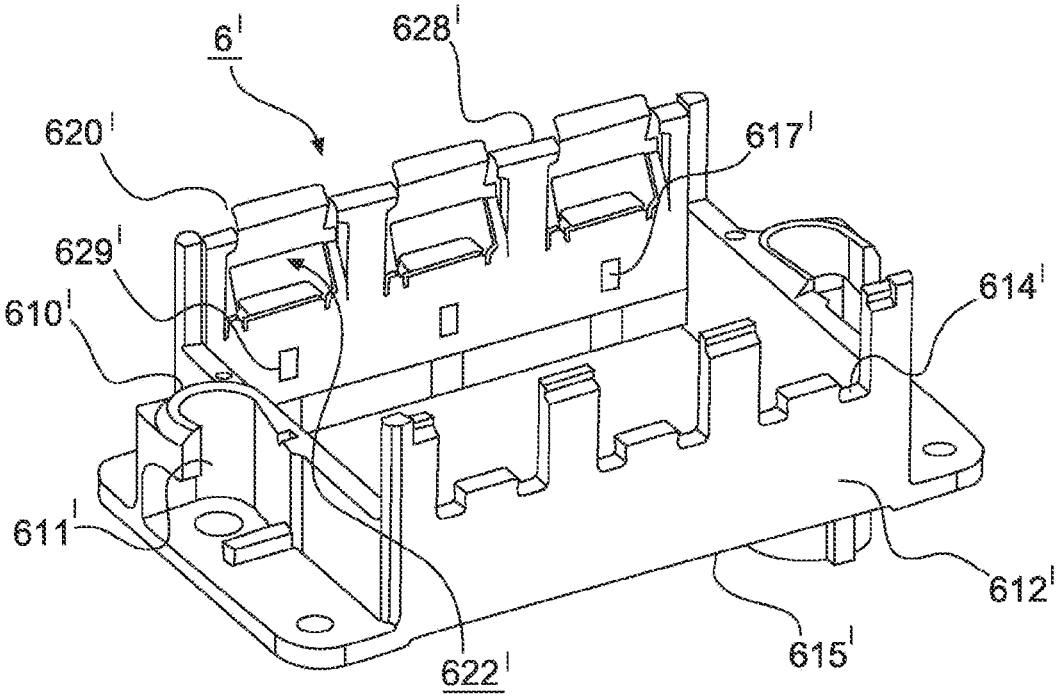
FIG. 21 shows a perspective view of a holding frame according to a variant of the sixth embodiment.
Figure 22:
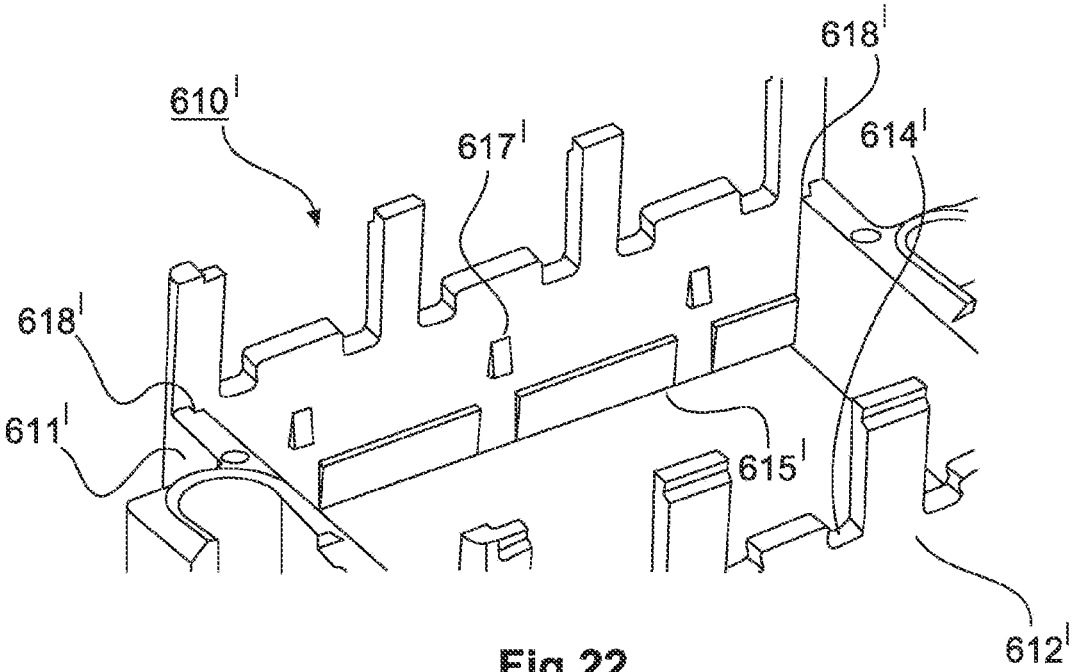
FIG. 22 shows a partial perspective view of the base frame of the holding frame shown in FIG. 21.
Figure 23:
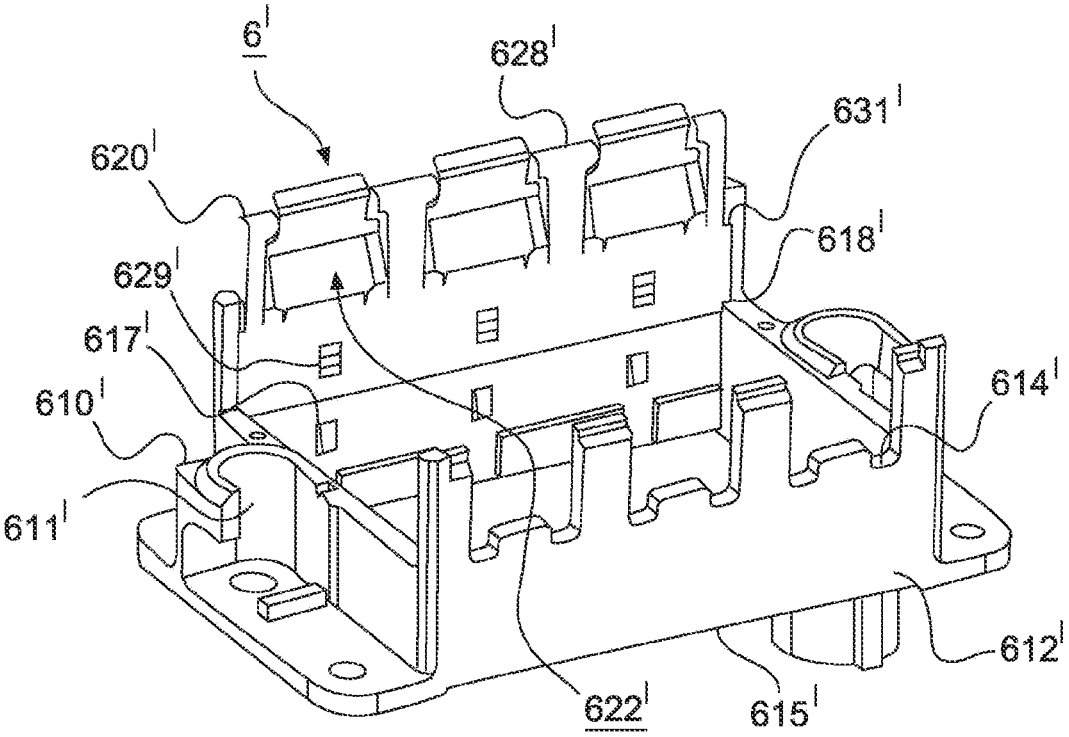
FIG. 23 shows a view of the holding frame of FIG. 21, with a flange part partly inserted into the base frame.

FIG. 21 shows a perspective view of a holding frame 6' according to a variant of the sixth embodiment, FIG. 22 shows a partial perspective view of a base frame 610' of holding frame 6' shown in FIG. 22, and FIG. 23 shows a view of the holding frame 6' of FIG. 21, with a flange part 620' partly inserted into base frame 610'.

The variant illustrated in FIGS. 21-23 differs from the embodiment shown in FIGS. 18-20 in the way that flange parts 620' are secured in position at the inner wall of base frame 610'.

As in the above embodiment, holding frame 6' includes a base frame 610' comprising end faces 611', side walls 612', a lower edge 615', upper edges 614' and undercuts 617', and flange parts 620' with latching windows 622', clip sections 628' and undercuts 629', so reference can be made in this regard to the statements in the foregoing.

Departing from the approach involving the flange parts being spaced apart by webs, the base frame 610' in this variant has a groove 618', in the abutment region of end faces 611' and side walls 612', which is provided to receive a guide portion 631' of the flange part 620'. When flange part 620' is attached to base frame 610', guide portions 631' enter grooves 618', thus holding the respective flange part 620' against the inner side of base frame 610'.

Due to the interaction of undercuts 617', 629' and clip sections 628', any movement of flange part 620' relative to the base frame 610' along the insertion direction is prevented.

Figure 24:
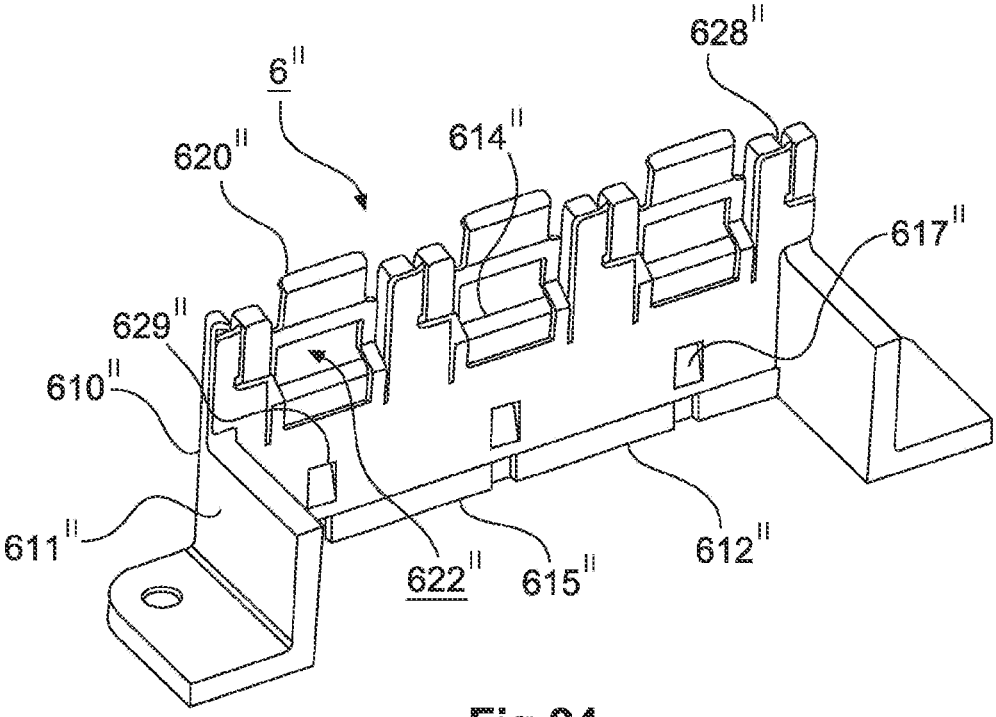
FIG. 24 shows a perspective and partial cross-sectional view of a holding frame according to another variant of the sixth embodiment.
Figure 25:
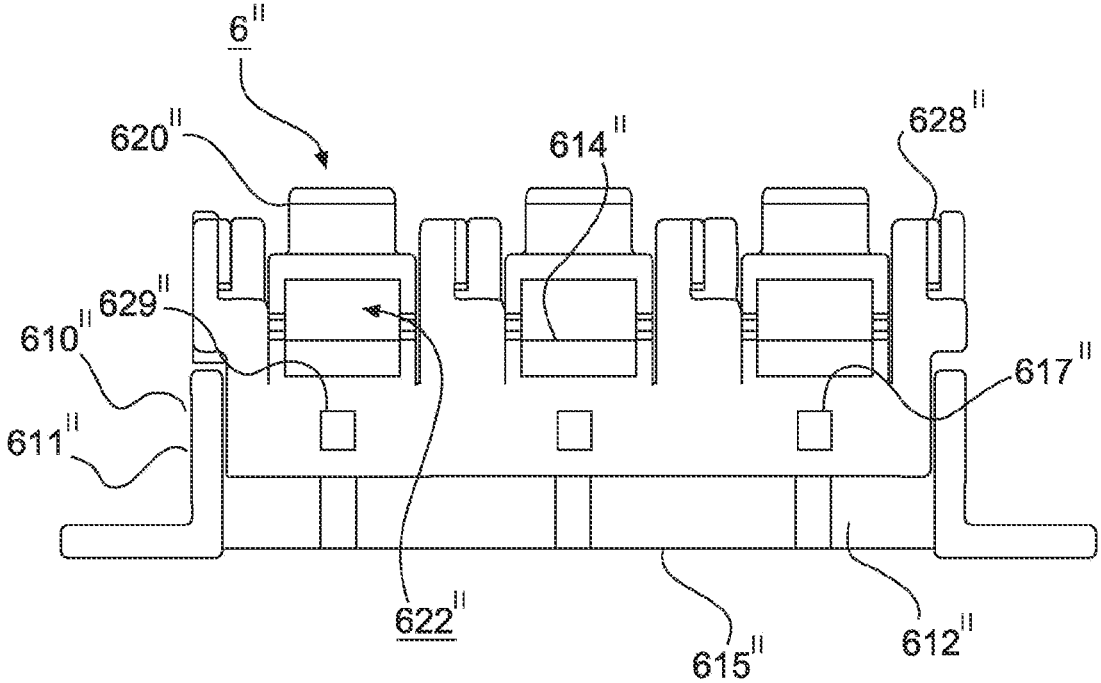
FIG. 25 shows an inside view, in partial cross-section, of the holding frame of FIG. 24.
Figure 26:
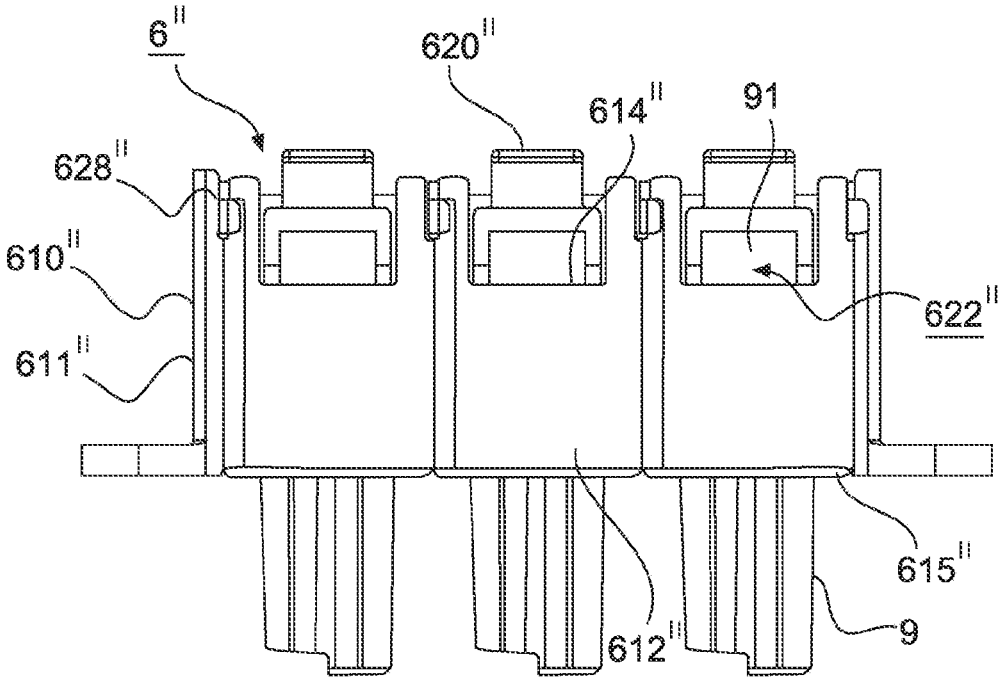
FIG. 26 shows an outer side view of the holding frame shown in FIG. 24.
Figure 27:
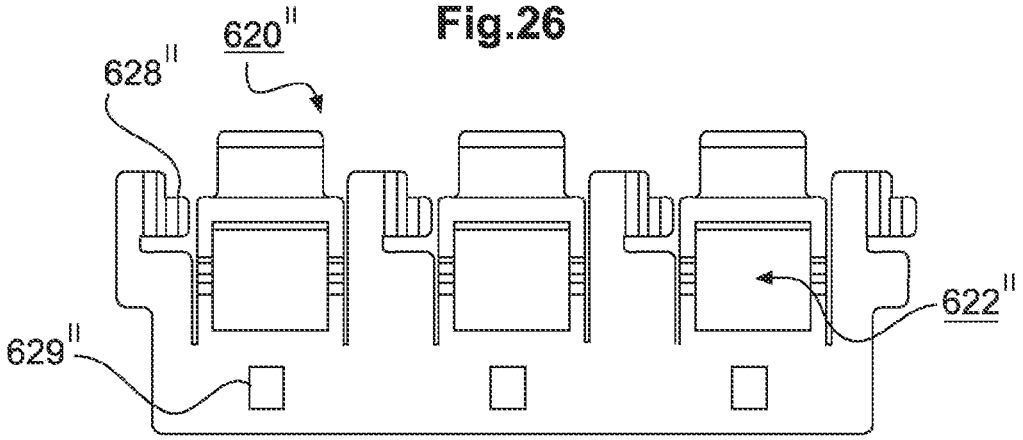
FIG. 27 shows a view of a flange part of the holding frame shown in FIG. 24.
Figure 28:
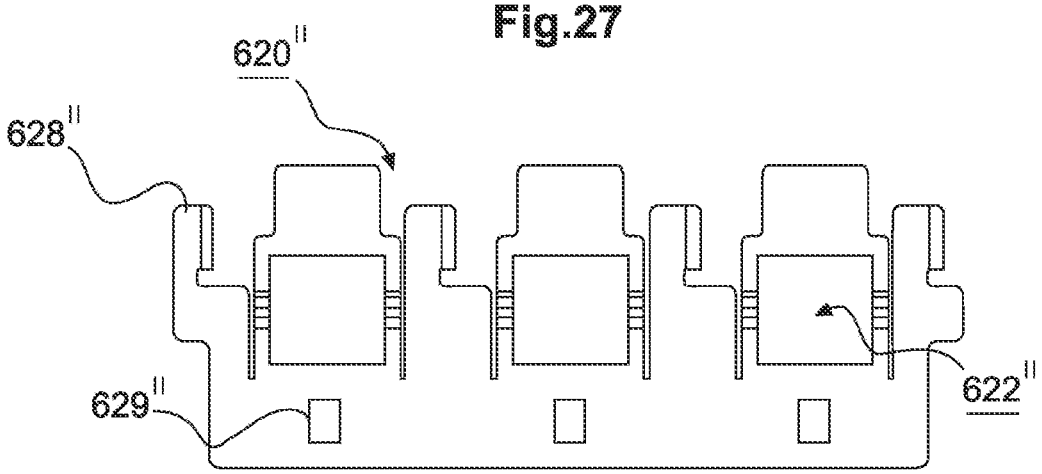
FIG. 28 shows another view of the flange part shown in FIG. 27.

FIG. 24 shows a perspective and partial cross-sectional view of a holding frame 6" according to another variant of the sixth embodiment. FIG. 25 shows an inside view, in partial cross-section, of the holding frame 6" of FIG. 24, and FIG. 26 shows an outside view of the holding frame 6" shown in FIG. 24. FIG. 27 shows a view of a flange part 620" of the holding frame 6" shown in FIG. 24, and FIG. 28 shows another view of the flange part 620" shown in FIG. 27.

Compared to the above embodiment shown in FIGS. 18-20 and the variant shown in FIGS. 21-23, yet another variant is shown here in which another different approach is pursued for securing flange parts 620" to the inner sides of base frame 610".

As in the above embodiment and the variants thereof, holding frame 6" includes a base frame 610" comprising end faces 611", side walls 612", a lower edge 615", upper edges 614" and undercuts 617", and flange parts 620" with latching windows 622", clip sections 628" and undercuts 629", so reference can be made in this regard to the statements in the foregoing.

In this case, however, the clip sections 628" are so designed that they do not lie around an edge of base frame 610" in its longitudinal direction, but around an edge that results from a slot in the insertion direction, starting from the upper edge of base frame 610". Alternatively or additionally thereto, a clip section 628" can also extend through an opening in base frame 610".

When clip section 628" abuts in the insertion direction, this produces stability against the respective flange part 620" lifting away from the inner side of base frame 610".

Figure 29:
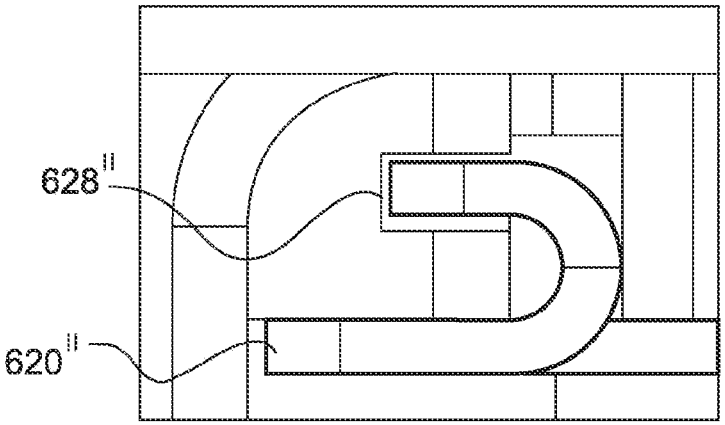
FIG. 29 shows a top view of a slot for accommodating a clip section according to the variant of the sixth embodiment shown in FIG. 24.

FIG. 29 shows a top view of a slot for accommodating a clip section according to the variant of the sixth embodiment shown in FIG. 24. It is not necessary that clip section 628" extend as far as the outer side of base frame 610", because clip section 628" can also be received in a receptacle as illustrated in FIG. 29.

Figure 30:
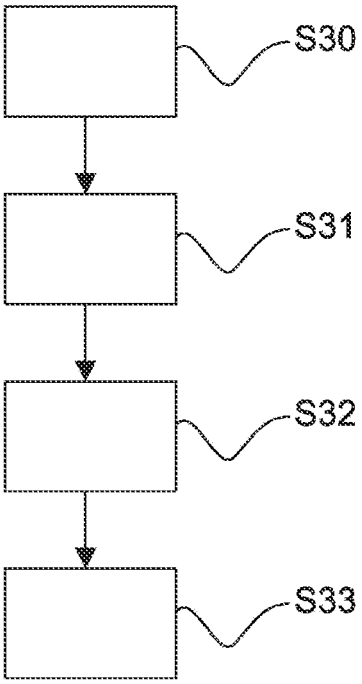
FIG. 30 shows a schematic flow diagram of another embodiment of the method of populating a holding frame with a module according to the invention.

FIG. 30 shows a schematic flow diagram of a method of populating a holding frame with a module according to another embodiment of the invention.

In step S30, a base frame is firstly provided that defines a plane transverse to an insertion direction of a module into the holding frame and having mutually opposite end faces and mutually opposite side walls.

In step S31, at least two flange parts are attached opposite each other to the side walls of the base frame, such that each flange part extends inside the base frame along an inner face of the base frame in the opposite direction to the insertion direction and beyond an edge of the base frame in the opposite direction to the insertion direction, wherein each flange part has at least one latching window, in the region extending beyond the edge of the base frame, as a latching element for receiving a latching lug of the module, wherein the flange parts are designed to undergo elastic bending and deformation between an insertion state which allows the module to be inserted into the holding frame in the insertion direction, and a holding state in which an inserted module is fixed in place at least along the insertion direction by the latching lug engaging into the latching window.

In the process, or as a consequence thereof, a form fit between each flange part and the base frame is achieved in step S32, at least with regard to relative displacement along the insertion direction.

Each flange part has at least one clip section extending above a lower edge of the base frame into the base frame, through the base frame and/or around an edge of the base frame.

Next, with the holding frame thus produced, the module is then inserted into the base frame in step S33, with insertion step S33 being performed between at least two flange parts and said insertion step S33 including elastic bending of the flange parts, supported by the base frame, to an insertion state.

The method includes elastic deformation of the flange parts back from the insertion state to a holding state, the inserted module being fixed in the holding state at least along the insertion direction by the latching lug engaging in the latching window, wherein release of the form fit between flange parts and the base frame is prevented by an inserted module.

Figure 31:
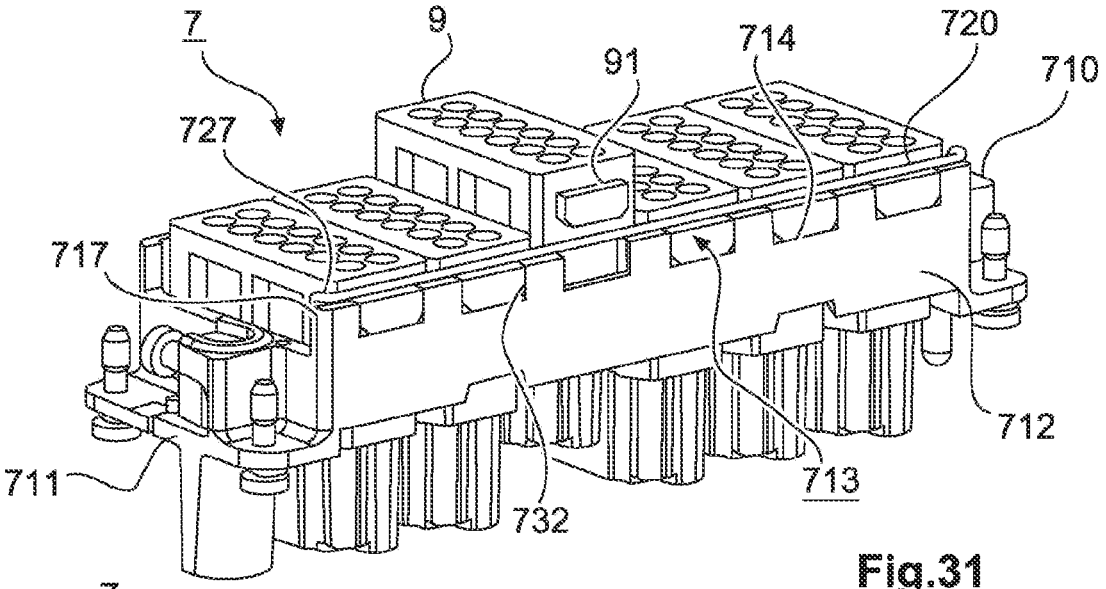
FIG. 31 shows a perspective view of an assembled holding frame arrangement according to a seventh embodiment, with modules inserted.
Figure 32:
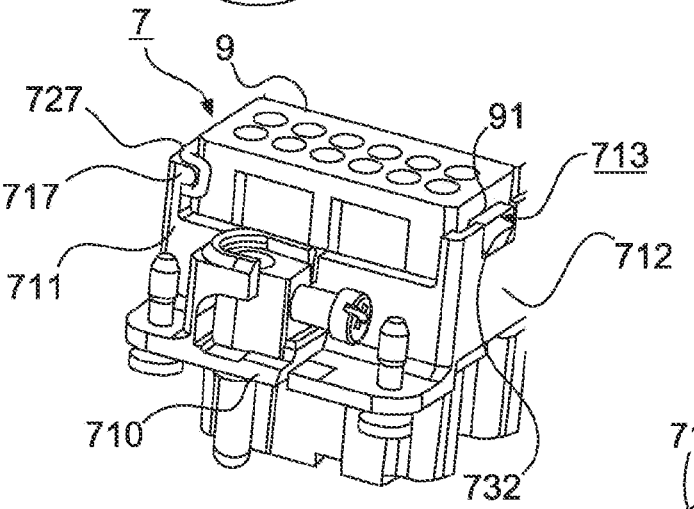
FIG. 32 shows a perspective view of a detail of the holding frame arrangement with modules as shown in FIG. 31.
Figure 33:
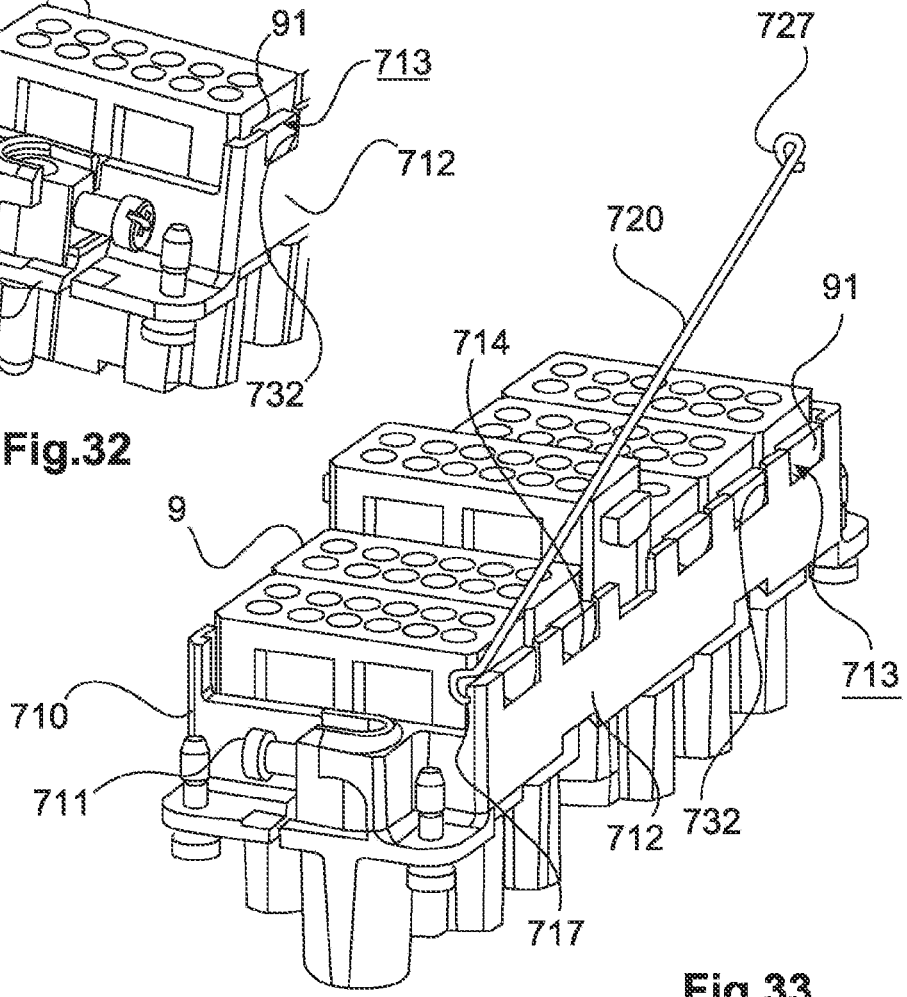
FIG. 33 shows a perspective view of the holding frame arrangement shown in FIG. 31 and FIG. 32, with a released securing clip.

FIG. 31 shows a perspective view of an assembled holding frame arrangement 7 according to a seventh embodiment, with modules inserted. FIG. 32 shows a perspective view of a detail of the holding frame arrangement 7 with modules 9 as shown in FIG. 31, and FIG. 33 shows a perspective view of the holding frame arrangement 7 shown in FIG. 31 and FIG. 32, with a released securing clip 720.

The base frame 710 of holding frame arrangement 7 comprises mutually opposite end faces 711 and mutually opposite side walls 712.

Side walls 712 each have recesses 713 that are partly framed by an edge portion 714 and two guide portions 732 and which are provided to each receive a latching lug 91 of a module 9.

Guide portions 732 are provided at different distances apart on mutually opposite side walls 712, so a respective module can be inserted with one orientation only. FIG. 31 shows holding frame arrangement 7 in the assembled state, i.e., with securing clip 720 attached to base frame 710.

Securing clip 720 extends along an upper edge of base frame 710, thus closing recesses 713 such that latching lugs 91 and thus modules 9 are fixed in place against any movement in a direction defined by the side walls 712.

Securing clip 720 has claws 727 bent at an angle of 90°, as respective examples of an engagement member 727. Claws 727 engage with undercuts 717 in the end faces 711 of base frame 710, so that securing clip 720 is secured to base frame 710.

Only one securing clip 720 is provided in the present case, although one securing clip 720 can also be provided for each of the two side walls 712. It is also possible to design the securing clip shorter, for example in such a way that only one or few latching lugs are affected by it.

To attach securing clip 720, which is made of wire here, the securing clip 720 can be placed onto the upper edge of base frame 710, for example, followed by pivoting the securing clip 720 about its longitudinal axis.

Since the securing clip 720 made of wire has a certain amount of flexibility and elasticity, it is also possible—for example if torsion is applied to the securing clip—for engaging elements 727 to be engaged one after the other (see FIG. 33, where only one engagement member 727 is engaged).

Figure 34:
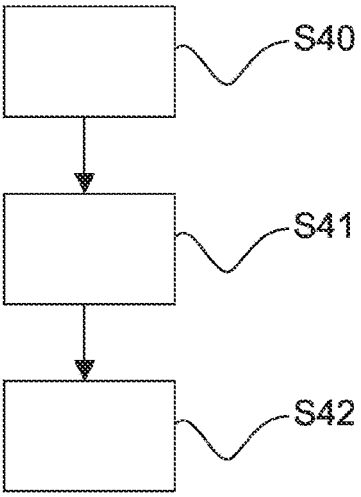
FIG. 34 shows a schematic flow diagram of an embodiment of the method of populating a holding frame with a module according to the invention.

FIG. 34 shows a schematic flow diagram of a method of populating a holding frame with a module according to another embodiment of the invention.

The method of populating a holding frame arrangement with a module comprises step S40 of inserting the module into a base frame of the holding frame arrangement.

This base frame defines a plane transverse to the insertion direction of the module into the holding frame arrangement and has mutually opposite end faces and mutually opposite side walls.

In the process of insertion in step S40, the latching lugs of the module abut respective upper edge portions of the side walls, in the insertion direction (step S41).

After insertion of the modules to be inserted, a securing clip that has an engagement member at each end is then attached in step S42.

In attachment step S42, both engagement members engage with a matching fixing section of the base frame.

The securing clip is thus attached to the base frame by engagement of engagement members in such a way that one or more latching lugs of the inserted module(s) are held between the edge portion of the base frame and the securing clip, at least with regard to movement in the insertion direction.

Figure 35:
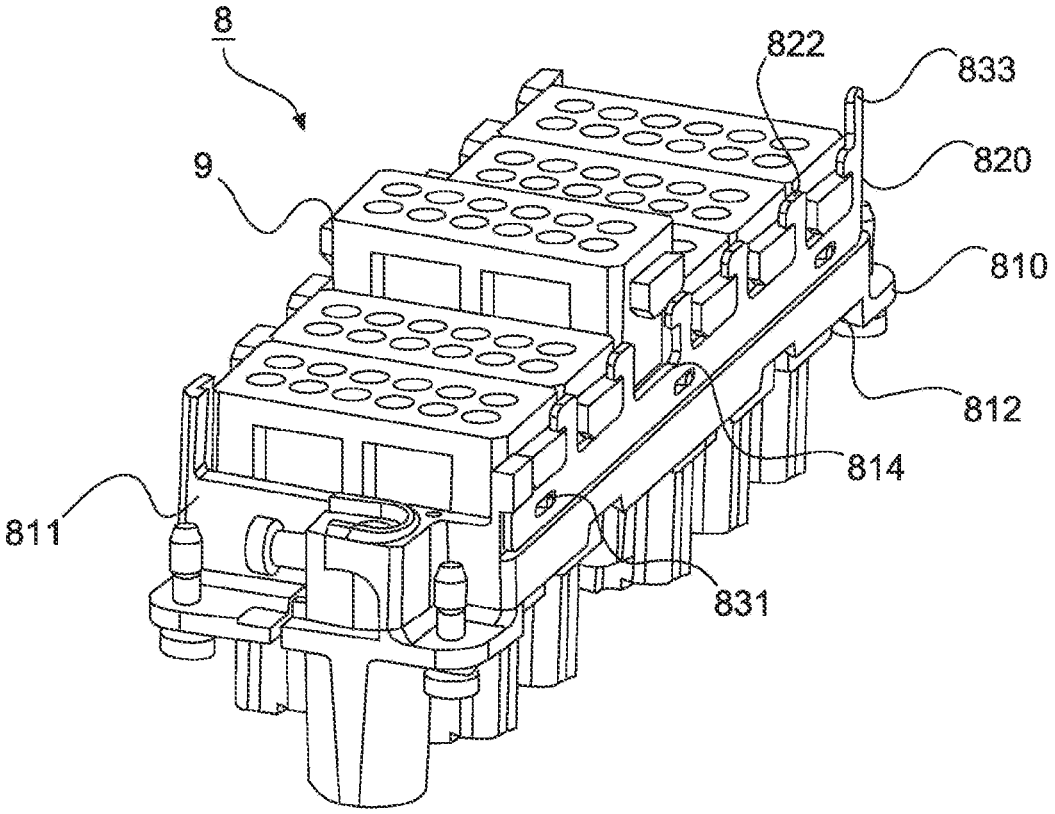
FIG. 35 shows a perspective view of a holding frame according to an eighth embodiment.
Figure 36:
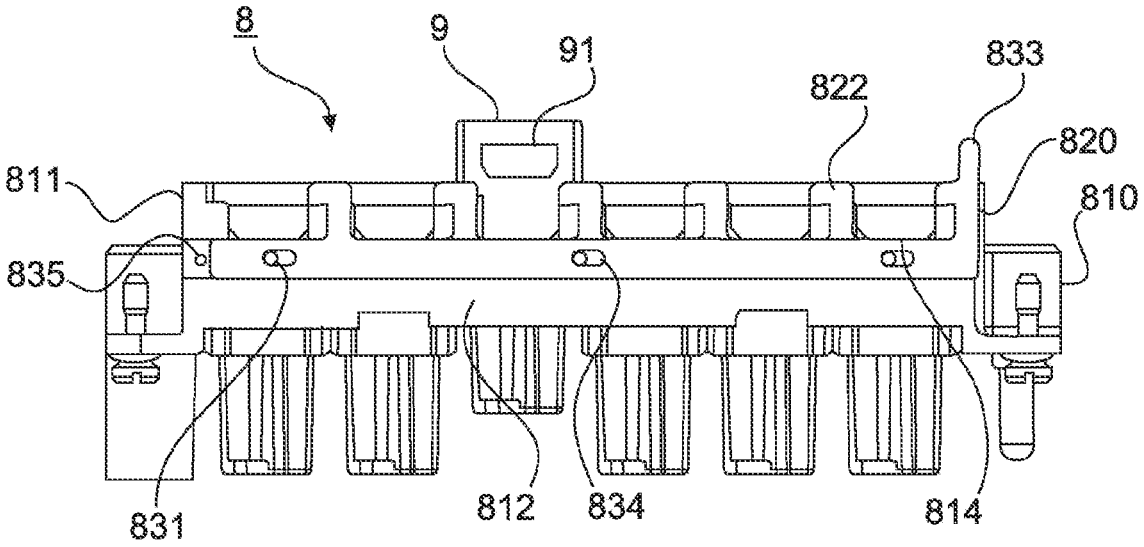
FIG. 36 shows a side view of the holding frame shown in FIG. 35, in the insertion state.
Figure 37:
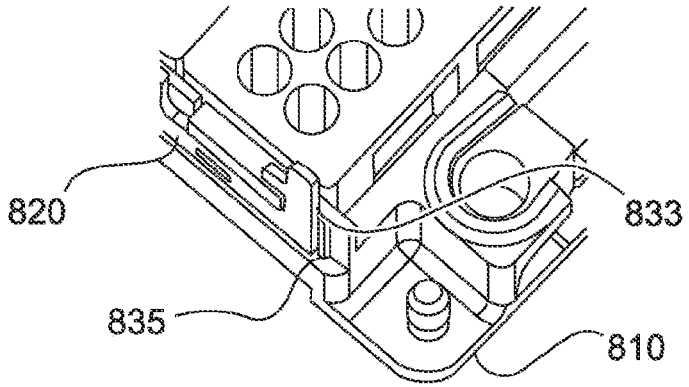
FIG. 37 shows a perspective view of a detail of the holding frame shown in FIG. 35 and FIG. 36, in the holding state.

FIG. 35 shows a perspective view of holding frame 8 according to an eighth embodiment, in the holding state, whereas FIG. 36 shows a side view of the holding frame 8 shown in FIG. 35, in the insertion state, and FIG. 37 shows a perspective view of a detail of holding frame 8 shown in FIG. 35 and FIG. 36, in the holding state.

The base frame 810 of holding frame 8 comprises end faces 811 and side walls 812. Base frame 810 also has recesses on its upper side, each of which ends with an edge 814 for receiving a latching lug 91 of a module 9.

A fixing member 820 is attached to side wall 812 of base frame 810, namely with the aid of guides 831 on the side wall 812 of base frame 810, which extend through respective elongate holes 834 in fixing member 820.

Fixing element 820 can thus be moved along the longitudinal direction of the side wall and in particular can adopt an insertion state (FIG. 36) and a holding state (FIG. 35, FIG. 37).

In the holding state, a respective protrusion 822 on fixing member 820 extends into the region of the recess and in combination with edge 814 fixes latching lug 91 of module 9 in place along the direction of insertion.

In the insertion state, protrusion 822 is away from the region of the respective recess, so the path is free for insertion (or removal) of a module 9.

To simplify handling, fixing 820 has a handle 833 projecting in the opposite direction to the insertion direction.

Base frame 810 also has blocking members 835 arranged in front of and behind fixing member 820, in the longitudinal direction of side wall 812, and which hold fixing member 820 in the holding state or in the insertion state by frictional engagement.

Figure 38:
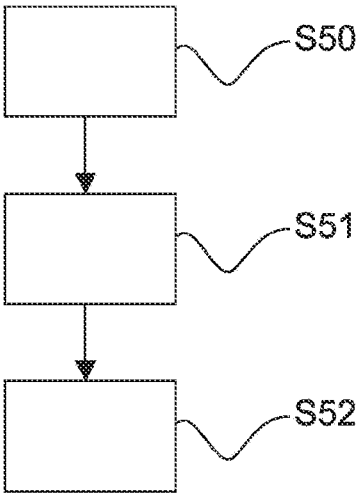
FIG. 38 shows a schematic flow diagram of an embodiment of the method of populating a holding frame with a module according to the invention.

FIG. 38 shows a schematic flow diagram of a method of populating a holding frame with a module according to another embodiment of the invention.

The starting point for populating is a holding frame in an insertion state, the module being inserted (S50) into a base frame of the holding frame, which defines a plane transverse to an insertion direction of the module into the holding frame and has mutually opposite end faces and mutually opposite side walls, with a fixing member that allows insertion of the module into the holding frame in the insertion direction being attached to a side wall of the base frame.

Once insertion step S50 has been completed, and the latching lug abuts an edge of the base frame (or of the fixing member) (step S1), the following step S52 involves moving the fixing member, with a module inserted, along a longitudinal direction of the side wall from the insertion state to a holding state in which the inserted module is fixed in place by a latching lug of the module and the fixing member, along the insertion direction at least.

The fixing member has a protrusion extending in the longitudinal direction, which fixes the latching lug of the module when in the holding state, and which is removed from an insertion path of the latching lug when in the insertion state.

Even if different aspects or features of the subject-matter of the present application are shown in combination in the Figures, it is clear to a person skilled in the art, unless otherwise specified, that the combinations shown and discussed are not the only ones possible. More particularly, it is possible to swap corresponding units or groups of features from different embodiments.

The technical features of the holding frames or holding frame arrangements discussed above, for fixing or securing the modules, or the like, are preferably provided on or at two side walls of the base frame, in particular in symmetrical or mirrored form (except for coding), so that each module is held at both latching lugs. However, it is also possible in the context of the present invention(s) that such features are provided only on or to one side wall. It is also possible to combine embodiments of different aspects with each other, so that a holding frame or a holding frame variant has features of one aspect on one side or in one section, while another side or another section has features of a different aspect.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame arrangement for a plug connector for receiving similar and/or different modules, comprising:

a base frame which defines a plane transverse to an insertion direction of a module into the holding frame arrangement, and has mutually opposite end faces and mutually opposite side walls, and at least one securing clip which can be attached to the base frame and detached from the base frame, wherein the base frame has one or more upper edge portions in the side walls, which are provided so that a respective latching lug of an inserted module comes into contact with the one or more upper edge portions, wherein the securing clip is configured to be detached from the base frame so as to allow insertion or removal of the latching lug from between the edge portions, wherein the securing clip has an engagement member at each of opposing ends of the securing clip, each of which is designed to be brought into engagement with a matching fixing section of the base frame upon attaching the securing clip to the base frame, wherein the securing clip with the engagement members is coupleable to the base frame in such a way that one or more latching lugs of inserted modules are held between the one or more edge portions of the base frame and the securing clip, at least with regard to movement in the insertion direction.

2. The holding frame arrangement according to claim 1, wherein the base frame has two guide portions each connected to one of the upper edge portions and protruding in the opposite direction to the insertion direction and which are designed to guide a latching lug of an inserted module and which fix the inserted module in a longitudinal direction of the base frame by the latching lug.

3. The holding frame arrangement according to claim 1, wherein the securing clip is substantially linear between the engagement members.

4. The holding frame arrangement according to claim 1, wherein the fixing sections of the base frame are formed in the end faces of the base frame.

5. The holding frame arrangement according to claim 1, wherein the securing clip is deformed upon attaching the securing clip to the base frame and upon detaching the securing clip from the base frame.

6. The holding frame arrangement according to claim 5, wherein the securing clip is elastically deformed upon attaching the securing clip to the base frame and upon detaching the securing clip from the base frame.

7. The holding frame arrangement according to claim 1, wherein the securing clip is configured such that, upon the attachment of the securing clip to the base frame, the securing clip does not protrude beyond the lateral circumference of the base frame.

8. A holding frame for a plug connector for receiving similar and/or different modules, comprising:

a base frame which defines a plane transverse to an insertion direction of a module into the holding frame, and which has mutually opposite end faces and mutually opposite side walls, and a fixing member which is attached to a side wall of the base frame and is adapted for displacement along a longitudinal direction of the side wall between an insertion state that allows the module to be inserted into the holding frame in the insertion direction, and a holding state in which an inserted module is fixed in place, at least along the insertion direction, by a latching lug of the module and the fixing member, wherein the side wall of the base frame includes a recess into which the latching lug is insertably received, wherein the fixing member has a protrusion extending in the longitudinal direction, which fixes the latching lug of the module within the recess of the side wall of the base frame when in the holding state, and which is removed from an insertion path of the latching lug when in the insertion state, wherein the base frame and/or the fixing member have at least one blocking member that, in the holding state at least, releasably blocks the fixing member by form-locking and/or frictional engagement.

9. The holding frame according to claim 8, wherein the fixing member is form-fittingly attached to an inner face or an outer face of the base frame or inside a side wall of the base frame.

* * * * *